US010286673B2

(12) United States Patent
Takahashi et al.

(10) Patent No.: US 10,286,673 B2
(45) Date of Patent: May 14, 2019

(54) LIQUID CARTRIDGE HAVING ENGAGING PORTION, AND LIQUID-CONSUMING DEVICE USING THE SAME

(71) Applicant: BROTHER KOGYO KABUSHIKI KAISHA, Nagoya-shi, Aichi-ken (JP)

(72) Inventors: Hiroaki Takahashi, Nagoya (JP); Kosuke Nukui, Nagoya (JP); Toyonori Sasaki, Anjo (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/473,900

(22) Filed: Mar. 30, 2017

(65) Prior Publication Data

US 2018/0093485 A1 Apr. 5, 2018

(30) Foreign Application Priority Data

Sep. 30, 2016 (JP) ..... 2016-192624

(51) Int. Cl.
*B41J 2/17* (2006.01)
*B41J 2/175* (2006.01)

(52) U.S. Cl.
CPC ..... *B41J 2/17526* (2013.01); *B41J 2/1752* (2013.01); *B41J 2/17513* (2013.01);
(Continued)

(58) Field of Classification Search
None
See application file for complete search history.

(56) References Cited

U.S. PATENT DOCUMENTS

2008/0239036 A1 10/2008 Hattori
2011/0310197 A1* 12/2011 Yazawa ..... B41J 2/17509 347/86

(Continued)

FOREIGN PATENT DOCUMENTS

EP 1 281 528 A1 2/2003
EP 2 886 346 A2 6/2015

(Continued)

OTHER PUBLICATIONS

Extended European Search Report issued in corresponding European Application No. 17163933.9, dated Oct. 18, 2017.

*Primary Examiner* — Erica S Lin
(74) *Attorney, Agent, or Firm* — Merchant & Gould P.C.

(57) ABSTRACT

A liquid cartridge includes: a front surface facing frontward; a rear surface spaced apart from the front surface; an upper surface facing upward; a bottom surface disposed opposite to the upper surface and facing downward; a liquid supply portion disposed at the front surface; an electrical interface disposed at the upper surface; a detection portion; and an engaging portion disposed at the bottom surface and configured to protrude downward relative to the bottom surface. The upper surface and the bottom surface are disposed between the front surface and the rear surface. The detection portion includes a light-receiving portion positioned upward relative to the upper surface and configured to receive light. The detection portion is configured to change a state of the light received at the light-receiving portion depending on a state of the liquid cartridge. The engaging portion includes an engaging surface facing rearward.

15 Claims, 13 Drawing Sheets

(52) U.S. Cl.
CPC ..... *B41J 2/17523* (2013.01); *B41J 2/17553* (2013.01); *B41J 2/17566* (2013.01); *B41J 2/17596* (2013.01)

(56) References Cited

U.S. PATENT DOCUMENTS

| | | | | |
|---|---|---|---|---|
| 2013/0278684 | A1* | 10/2013 | Kanbe | B41J 2/17526 347/86 |
| 2014/0009543 | A1 | 1/2014 | Yazawa | |
| 2016/0279958 | A1 | 9/2016 | Wang et al. | |

FOREIGN PATENT DOCUMENTS

| | | | |
|---|---|---|---|
| JP | 2013-49165 | A | 3/2013 |
| JP | 3183789 | U | 5/2013 |
| JP | 2015-196273 | A | 11/2015 |

* cited by examiner

LIQUID CARTRIDGE HAVING ENGAGING PORTION, AND LIQUID-CONSUMING DEVICE USING THE SAME

CROSS REFERENCE TO RELATED APPLICATION

This application claims priority from Japanese Patent Application No. 2016-192624 filed Sep. 30, 2016. The entire content of the priority application is incorporated herein by reference.

TECHNICAL FIELD

The present disclosure relates to a liquid cartridge storing liquid therein and a liquid-consuming device to which the liquid cartridge is attachable.

BACKGROUND

Conventionally, there has been known an inkjet printing apparatus configured to print images on printing mediums by ejecting ink stored in an ink cartridge through nozzles. Whenever ink stored in an ink cartridge runs out, a new ink cartridge is detachably mounted in such inkjet printing apparatus. For example, Japanese Patent Application Publication No. 2015-196273 discloses an ink cartridge that is attachable to and detachable from a printer.

SUMMARY

On an upper surface of this ink cartridge, a pivot member and an IC board are disposed. The pivot member is provided to maintain the ink cartridge in an attached state, and the IC board readably stores information on the ink cartridge. Further, a translucent portion is also disposed on the upper surface of this ink cartridge. The translucent portion is used to identify a type of the ink cartridge and an amount of ink left in the ink cartridge.

As in this example, various members for achieving various functions of the ink cartridge may be disposed concentrically on a particular surface (such as the upper surface) of the ink cartridge. However, in such cases, all of the necessary members may not be able to be disposed on the particular surface. Even if all the members were able to be disposed on the particular surface, all the members may not be arranged at prescribed positions at prescribed sizes.

In view of the foregoing, it is an object of the present disclosure to provide a liquid cartridge that can improve a degree of freedom in arrangement of members for achieving functions of the liquid cartridge.

In order to attain the above and other objects, the present disclosure provides a liquid cartridge configured to store liquid therein. The liquid cartridge includes a front surface, a rear surface, an upper surface, a bottom surface, a liquid supply portion, an electrical interface, a detection portion and an engaging portion. The front surface faces frontward. The rear surface is spaced apart from the front surface. The upper surface faces upward and is disposed between the front surface and the rear surface. The bottom surface is disposed between the front surface and the rear surface and opposite to the upper surface. The bottom surface faces downward. The liquid supply portion is disposed at the front surface and is configured to supply the liquid to outside of the liquid cartridge. The electrical interface is disposed at the upper surface. The detection portion includes a light-receiving portion configured to receive light thereon. The light-receiving portion is positioned upward relative to the upper surface. The detection portion is configured to change a state of the light received at the light-receiving portion depending on a state of the liquid cartridge. The engaging portion is disposed at the bottom surface and is configured to protrude downward relative to the bottom surface. The engaging portion includes an engaging surface facing rearward.

According to another aspect, there is provided a liquid-consuming device including a liquid cartridge, a cartridge-attachment section and a consuming section. The liquid cartridge includes: a front surface facing frontward; a rear surface spaced apart from the front surface; an upper surface facing upward and disposed between the front surface and the rear surface; a bottom surface facing downward and disposed opposite to the upper surface and between the front surface and the rear surface; a liquid supply portion disposed at the front surface and configured to supply the liquid to outside of the liquid cartridge; an electrical interface disposed at the upper surface; a detection portion; and an engaging portion disposed at the bottom surface. The electrical interface includes an electrode. The detection portion includes a light-receiving portion configured to receive light thereon, the light-receiving portion being positioned upward relative to the upper surface. The detection portion is configured to change a state of the light received at the light-receiving portion depending on a state of the liquid cartridge. The engaging portion is configured to protrude downward relative to the bottom surface and includes an engaging surface facing rearward. The liquid cartridge is attachable to the cartridge-attachment section in a frontward direction and detachable from the cartridge-attachment section in a rearward direction. The cartridge-attachment section includes a case configured to accommodate the liquid cartridge therein, a contact disposed at the case, and a sensor. The liquid cartridge attached to the case is in the attached state. The contact is electrically connected to the electrode of the electrical interface of the liquid cartridge attached to the case. The sensor includes a light-emitting portion and a light-receiving portion positioned opposite to each other. The light-receiving portion of the liquid cartridge attached to the case is configured to be interposed between the light-emitting portion and the light-receiving portion. The consuming section is configured to consume the liquid stored in the liquid cartridge attached to the case of the cartridge-attachment section.

DETAILED DESCRIPTION

Figure 1:
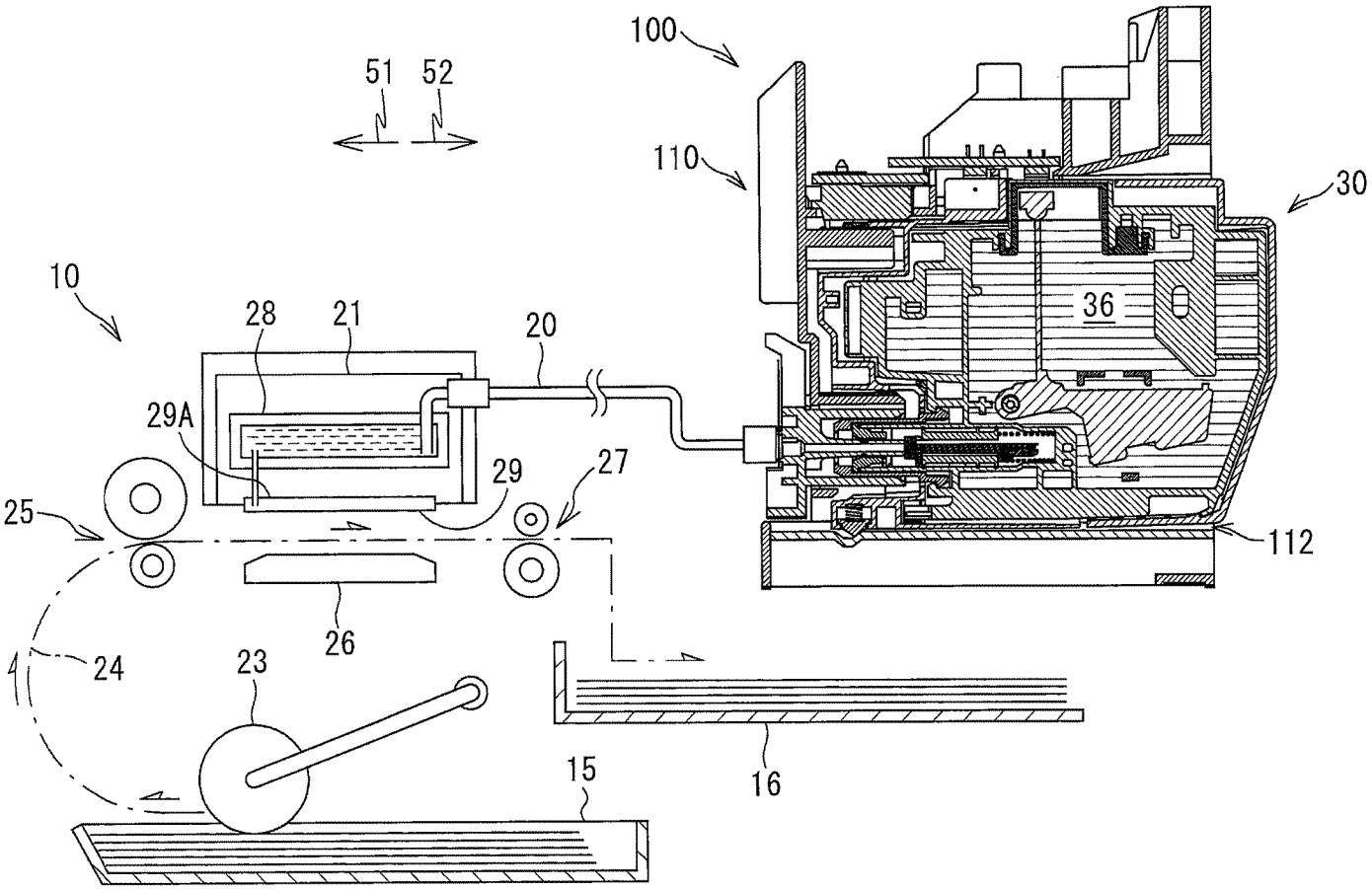
FIG. 1 is a schematic cross-sectional diagram conceptually showing an internal configuration of a printer provided with a cartridge-attachment section configured to detachably accommodate an ink cartridge according to an embodiment of the present disclosure.

Hereinafter, an embodiment of the disclosure is described in detail while referring to accompanying drawings. It would be apparent to those skilled in the art that the embodiment described below is merely an example of the present disclosure and modifications and variations may be made therein without departing from the scope of the disclosure.

In the following description, a frontward direction 51 is defined as a direction in which an ink cartridge 30 according to the embodiment is inserted into a cartridge-attachment section 110, while a rearward direction 52 is defined as a direction opposite the frontward direction 51, that is, a direction in which the ink cartridge 30 is extracted from the cartridge-attachment section 110. While the frontward direction 51 and rearward direction 52 are horizontal in the present embodiment, the frontward direction 51 and rearward direction 52 need not be horizontal.

Further, a downward direction 53 is defined as a direction coincident with a gravitational direction, while an upward direction 54 is defined as a direction opposite the downward direction 53. Further, a rightward direction 55 and a leftward direction 56 are defined as directions perpendicular to the frontward direction 51 and the downward direction 53. More specifically, in a state where the ink cartridge 30 has been received in the cartridge-attachment section 110, i.e., in a state where the ink cartridge 30 is in an attached posture, and when a user views the ink cartridge 30 from its front side, the rightward direction 55 is a direction toward the right and the leftward direction 56 is a direction toward the left.

Further, in the following description, the frontward direction 51 and the rearward direction 52 may be collectively referred to as a front-rear direction 51 and 52 (an example of a horizontal direction). The upward direction 54 and the downward direction 53 may be collectively referred to as an up-down direction 53 and 54 (an example of a vertical direction). The rightward direction 55 and the leftward direction 56 may be collectively referred to as a right-left direction 55 and 56 (an example of a widthwise direction).

In this specification, "facing frontward" includes facing in a direction including a frontward component, "facing rearward" includes facing in a direction including a rearward component, "facing downward" includes facing in a direction including a downward component, and "facing upward" includes facing in a direction including an upward component. For example, "a front surface faces frontward" denotes that the front surface may face in a frontward direction, or the front surface may face in a direction inclined relative to the frontward direction.

<Overview of Printer 10>

First, a printer 10 adapted to receive the ink cartridge 30 according to the embodiment will be described with reference to FIG. 1.

The printer 10 is configured to form an image by selectively ejecting ink droplets onto a sheet based on an inkjet recording system. The printer 10 is an example of a liquid-consuming device. As shown in FIG. 1, the printer 10 includes a recording head 21 (as an example of a consuming section), an ink-supplying device 100, and an ink tube 20 connecting the recording head 21 to the ink-supplying device 100. The ink-supplying device 100 includes the cartridge-attachment section 110. The cartridge-attachment section 110 can detachably accommodate the ink cartridge 30 therein. The ink cartridge 30 is an example of a liquid cartridge.

The cartridge-attachment section 110 has a surface formed with an opening 112. The ink cartridge 30 can be inserted into the cartridge-attachment section 110 in the frontward direction 51 through the opening 112, and extracted from the cartridge-attachment section 110 in the rearward direction 52 through the opening 112.

The ink cartridge 30 stores ink therein that the printer 10 can use for printing. The ink cartridge 30 is connected to the recording head 21 through the ink tube 20 when the ink cartridge 30 has been completely mounted in the cartridge-attachment section 110.

The recording head 21 includes a sub tank 28 for temporarily storing ink supplied from the ink cartridge 30 through the ink tube 20. The recording head 21 also includes a plurality of nozzles 29 through which the ink supplied from the sub tank 28 is selectively ejected in accordance with the inkjet recording system. More specifically, the recording head 21 includes a head control board (not shown), and piezoelectric elements 29A each corresponding to one of the nozzles 29. The head control board is configured to selectively apply drive voltages to the piezoelectric elements 29A to eject ink selectively from the nozzles 29. In this way, the recording head 21 is configured to consume the ink stored in the ink cartridge 30 that has been completely mounted in the cartridge-attachment section 110.

The printer 10 also includes a sheet tray 15, a sheet feeding roller 23, a conveying path 24, a pair of conveying rollers 25, a platen 26, a pair of discharge rollers 27, and a sheet discharge tray 16. The sheets from the sheet tray 15 are fed by the sheet feeding roller 23 onto the conveying path 24, and then conveyed by the conveying rollers 25 onto the platen 26. The recording head 21 is configured to selectively eject ink onto the sheets as the sheets move over the platen 26, thereby recording images on the sheets. The sheets that have passed the platen 26 are then discharged by the discharge rollers 27 onto the sheet discharge tray 16 disposed at a downstream end of the conveying path 24.

<Ink-Supplying Device 100>

The ink-supplying device 100 is provided in the printer 10, as shown in FIG. 1. The ink-supplying device 100 functions to supply ink to the recording head 21. As described above, the ink-supplying device 100 includes the cartridge-attachment section 110 for detachably receive the ink cartridge 30 therein. FIG. 1 shows a state where the ink cartridge 30 has been completely received in the cartridge-attachment section 110. In other words, the ink cartridge 30 is in the attached posture in FIG. 1.

<Cartridge-Attachment Section 110>

Figure 2:
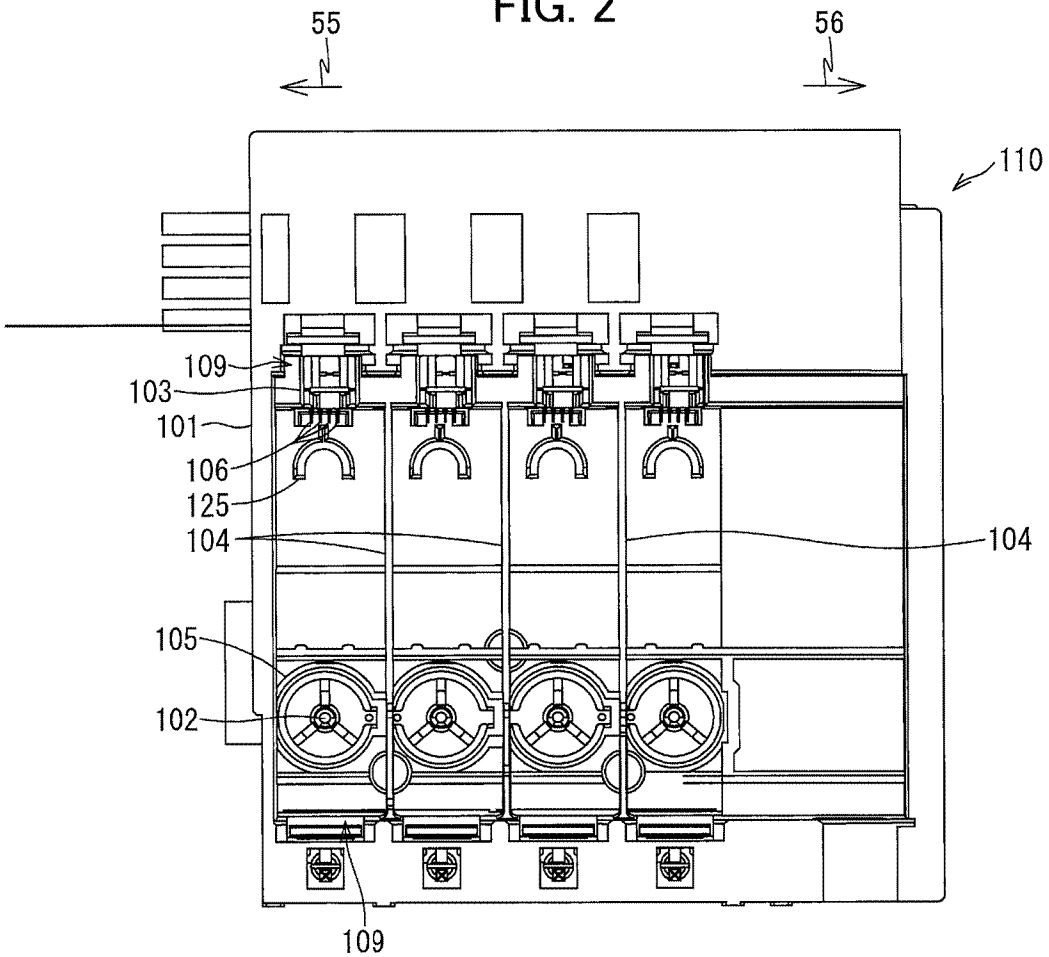
FIG. 2 is a view showing an external appearance of the cartridge-attachment section.
Figure 7:
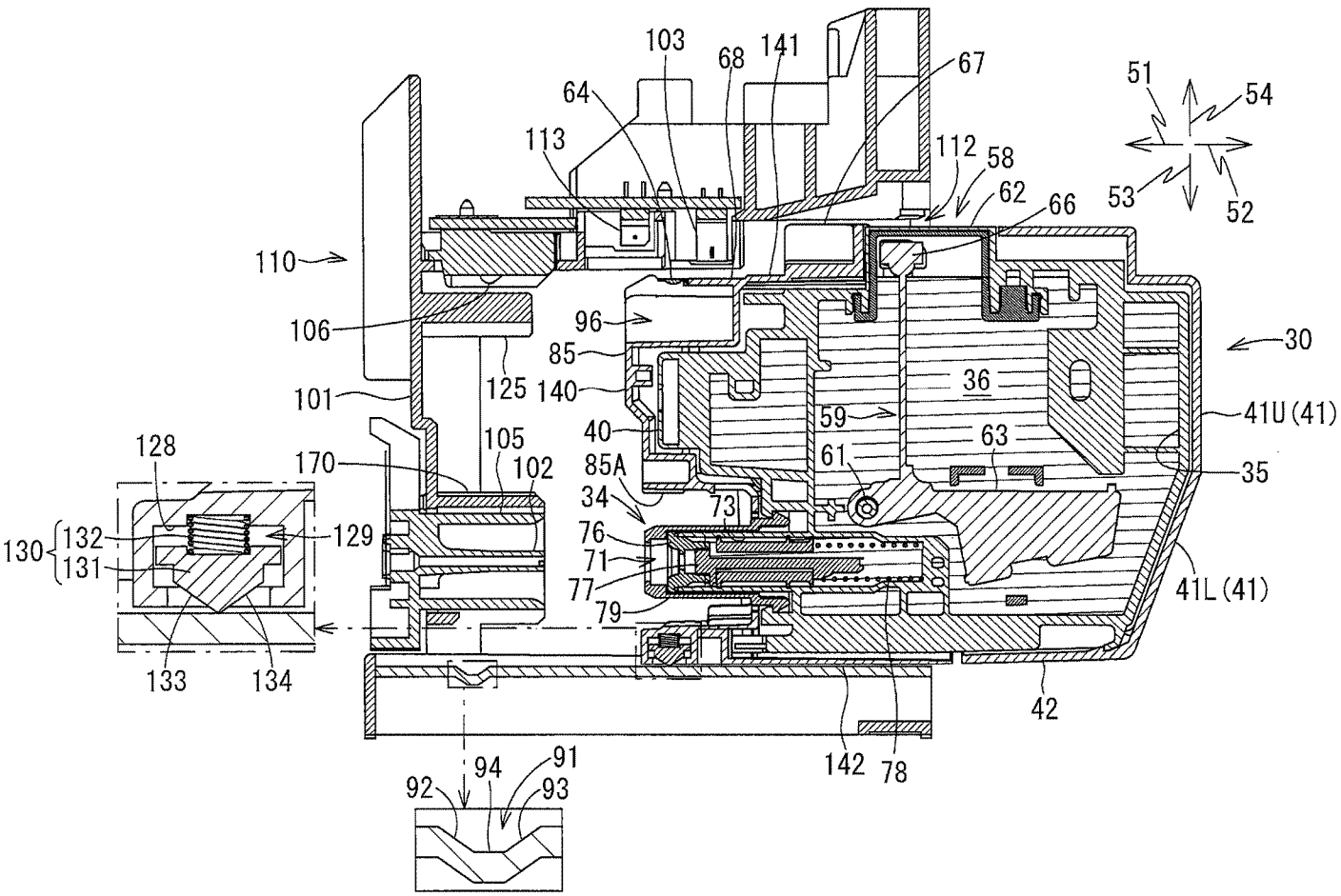
FIG. 7 is a vertical cross-sectional view illustrating the ink cartridge according to the embodiment and the cartridge-attachment section in a state where the ink cartridge is started to be inserted into the cartridge-attachment section.

In the ink-supplying device 100, four kinds of ink cartridges 30 corresponding to four colors of cyan, magenta, yellow and black are detachably mountable. Specifically, as shown in FIGS. 2 and 7, the cartridge-attachment section 110 includes a case 101, and four sets of an ink needle 102, an attachment sensor 113, a residual-amount sensor 103 and four contacts 106, each set for each of the four kinds of ink cartridges 30.

The case 101 constitutes a casing of the cartridge-attachment section 110. The case 101 has a box-like shape defining an internal space therein. Specifically, the case 101 includes a top wall defining a ceiling of the internal space, a bottom wall defining a bottom of the internal space, an end wall connecting the top wall and the bottom wall, and the opening 112 positioned opposite the end wall in the front-rear direction 51 and 52. The opening 112 can be exposed to a surface (user-interface surface) that a user can face when using the printer 10.

The four kinds of ink cartridges 30 can be inserted into and removed from the case 101 through the opening 112. In the case 101, each of the top wall and the bottom wall is formed with four guide grooves 109 for guiding insertion/removal of the ink cartridges 30. Specifically, when the ink cartridge 30 is inserted into and removed from the case 101 through the opening 112, upper and lower ends of the ink cartridge 30 are received in the corresponding upper and lower guide grooves 109 and guided thereby in the front-rear direction 51 and 52, as shown in FIG. 7. Further, the case 101 also includes three plates 104 that partition the internal space into four individual spaces each elongated in the up-down direction 53 and 54. Each of the four kinds of ink cartridges 30 can be mounted in a corresponding one of the four spaces defined by the plates 104.

Hereinafter, for simplifying explanation, only one ink cartridge 30 is assumed to be mounted in the case 101 of the cartridge-receiving section 110.

<Recess 91>

As shown in FIG. 7, a recess 91 is formed in the bottom wall of the case 101 at a position near the end wall constituting the case 101. The recess 91 is recessed downward in the bottom wall of the case 101.

Specifically, referring to FIG. 7, the recess 91 is defined by surfaces 92, 93 and 94. The surface 92 defines a front edge, the surface 93 defines a rear edge, and a surface 95 defines a bottom edge of the recess 91. More specifically, the surface 92 is inclined relative to the front-rear direction 51 and 52 such that: a top edge of the surface 92 is located frontward of a bottom edge of the surface 92; and the surface 92 faces rearward and upward. The surface 93 is inclined relative to the front-rear direction 51 and 52 such that: a top edge of the surface 93 is positioned rearward of a bottom edge of the surface 93; and the surface 93 faces frontward and upward. The surface 93 is an example of an engaged surface. The surface 94 has a front edge connected to the bottom edge of the surface 92, and a rear edge connected to the bottom edge of the surface 93.

Incidentally, the surfaces 92 and 93 may extend parallel to the up-down direction 53 and 54. Further, the recess 91 may be formed in the bottom wall of the case 101 at a position other than the vicinity of the end wall.

In the state in which the ink cartridge 30 is attached to the cartridge-attachment section 110, an engaging portion 130 (described later) of the ink cartridge 30 is fitted into the recess 91. At this time, the surface 93 of the recess 91 engages with a surface 134 (described later) of the engaging portion 130.

<Ink Needle 102>

The ink needle 102 is formed of a resin and has a generally tubular shape. As shown in FIG. 2, the ink needle 102 is disposed on a lower end portion of the end wall constituting the case 101. Specifically, the ink needle 102 is disposed at a position corresponding to an ink supply potion 34 (described later) of the ink cartridge 30 mounted in the cartridge-attachment section 110. The ink needle 102 protrudes rearward from the end wall of the case 101.

A cylindrical-shaped guide portion 105 is provided on the end wall to surround the ink needle 102. The guide portion 105 protrudes rearward from the end wall. The guide portion 105 has a protruding end that is open rearward. Specifically, the ink needle 102 is positioned at a diametrical center of the guide portion 105. The guide portion 105 is shaped to allow the ink supply potion 34 of the mounted ink cartridge 30 to be received in the guide portion 105.

Figure 8:
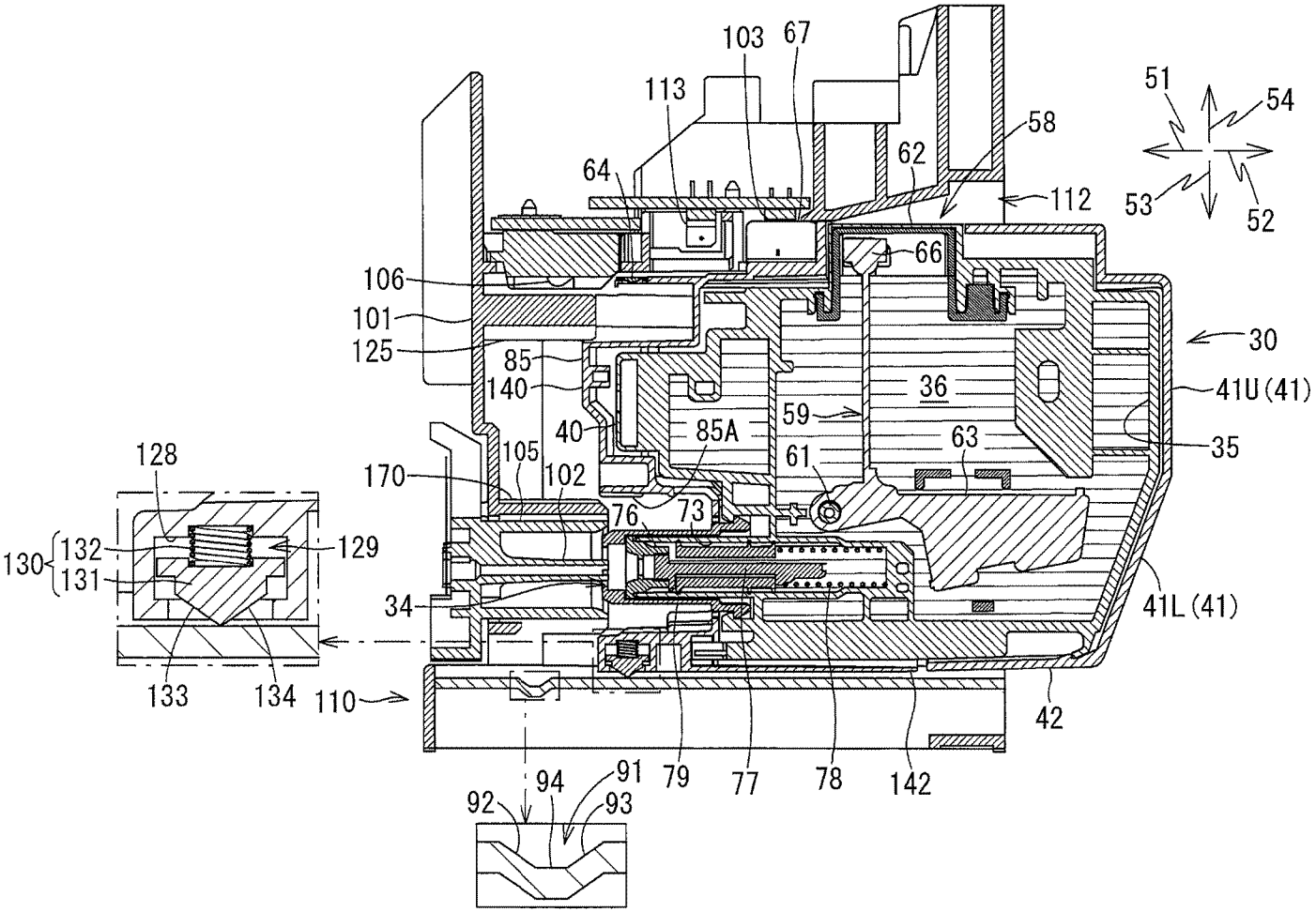
FIG. 8 is a vertical cross-sectional view illustrating the ink cartridge according to the embodiment and the cartridge-attachment section, and illustrating a state where: an ink supply portion of the ink cartridge stars entering into a guide portion of the cartridge-attachment section; and a rod of the cartridge-attachment section starts entering into a recessed portion of the ink cartridge.

During insertion of the ink cartridge 30 into the cartridge-attachment section 110 in the frontward direction 51, i.e., in the course of action for attaching the ink cartridge 30 to the cartridge-attachment section 110, the ink supply potion 34 of the ink cartridge 30 enters into the guide portion 105 (see FIG. 8). As the ink cartridge 30 is inserted further forward in the frontward direction 51, the ink needle 102 enters into an ink supply port 71 (described later) of the ink supply potion 34 (see FIG. 9). The ink needle 102 is thus connected to the ink supply potion 34 to allow communication with each other. Hence, the ink stored in an ink chamber 36 formed in the ink cartridge 30 is allowed to flow into the ink tube 20 connected to the ink needle 102 through an internal space defined in the ink supply potion 34 and an inner space defined in the ink needle 102. Incidentally, the ink needle 102 may have a flat-shaped tip end or a pointed tip end.

<Contacts 106>

Figure 3A:
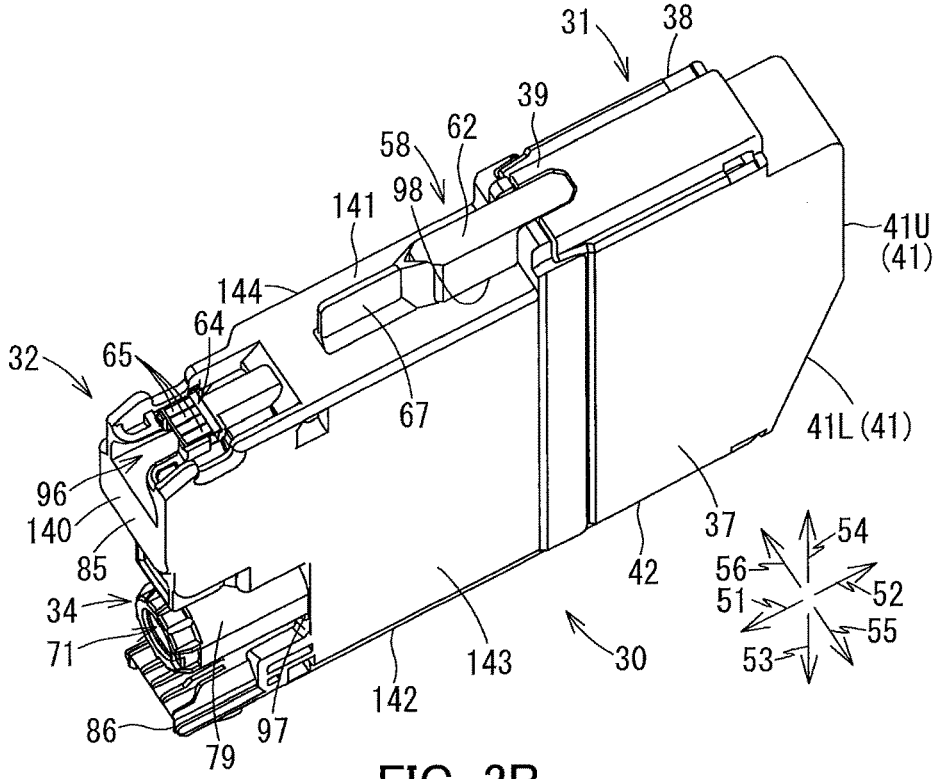
FIG. 3A is a perspective view showing an external appearance of the ink cartridge according to the embodiment when viewed from a perspective frontward and upward of the ink cartridge.
Figure 3B:
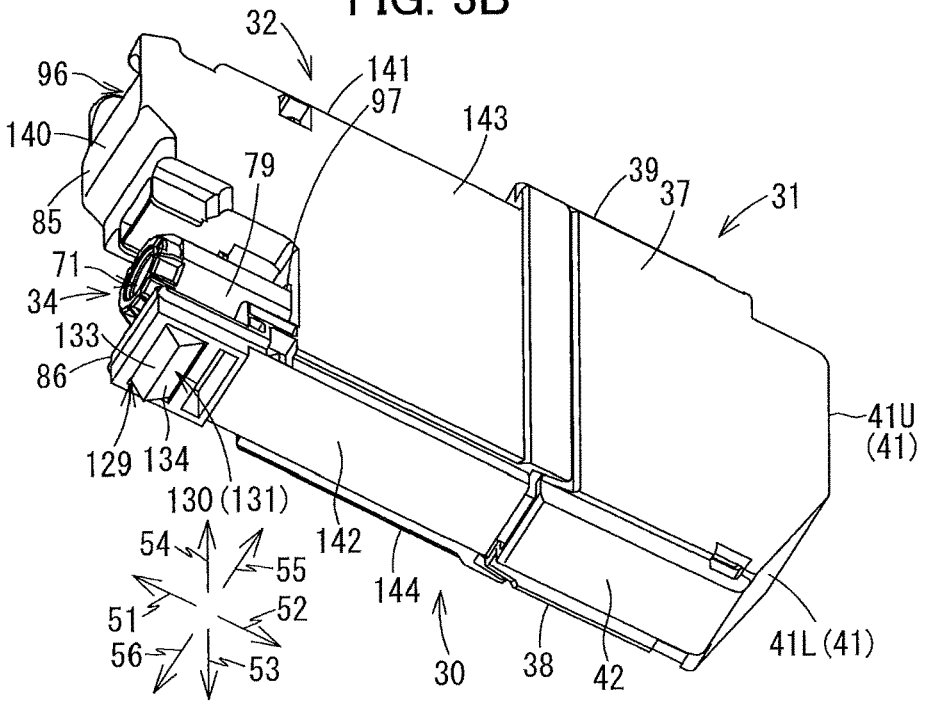
FIG. 3B is a perspective view showing the external appearance of the ink cartridge according to the embodiment when viewed from a perspective frontward and downward of the ink cartridge.
Figure 4A:
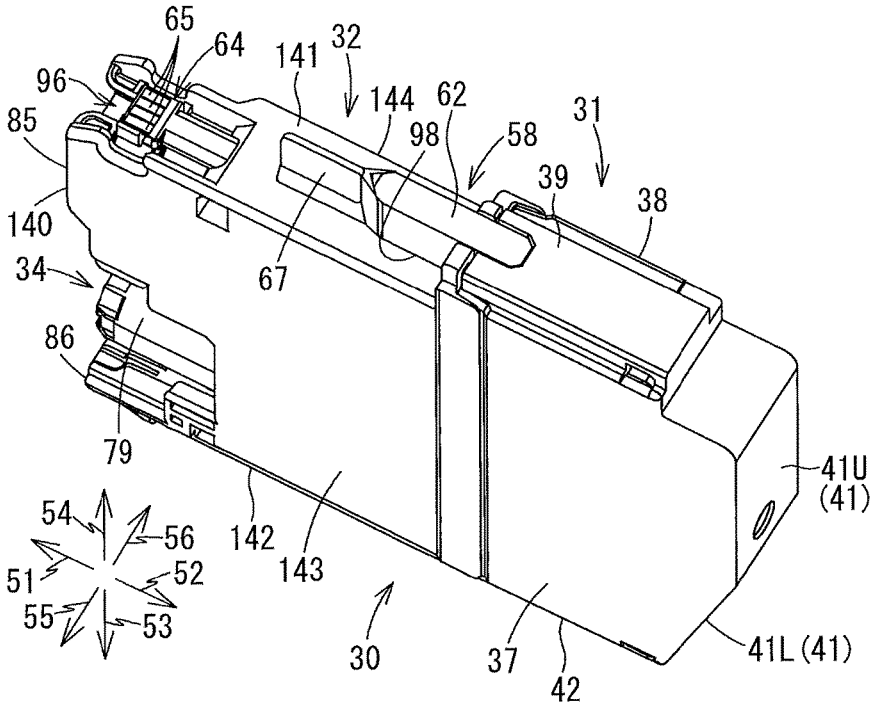
FIG. 4A is a perspective view showing the external appearance of the ink cartridge according to the embodiment when viewed from a perspective rearward and upward of the ink cartridge.
Figure 4B:
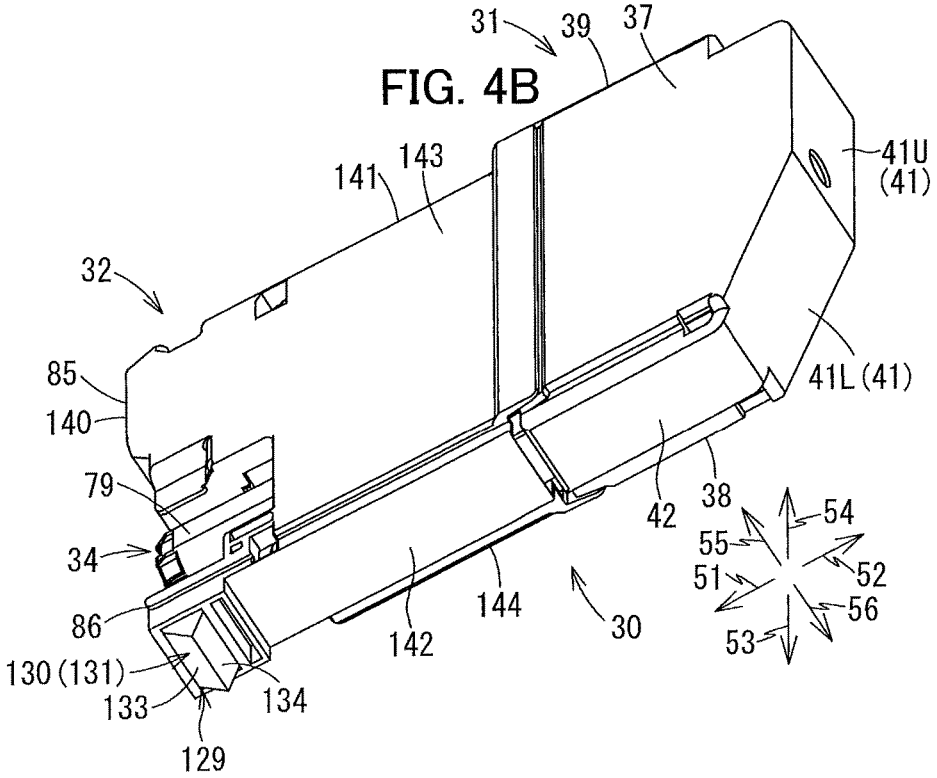
FIG. 4B is a perspective view showing the external appearance of the ink cartridge according to the embodiment when viewed from a perspective rearward and downward of the ink cartridge.
Figure 5:
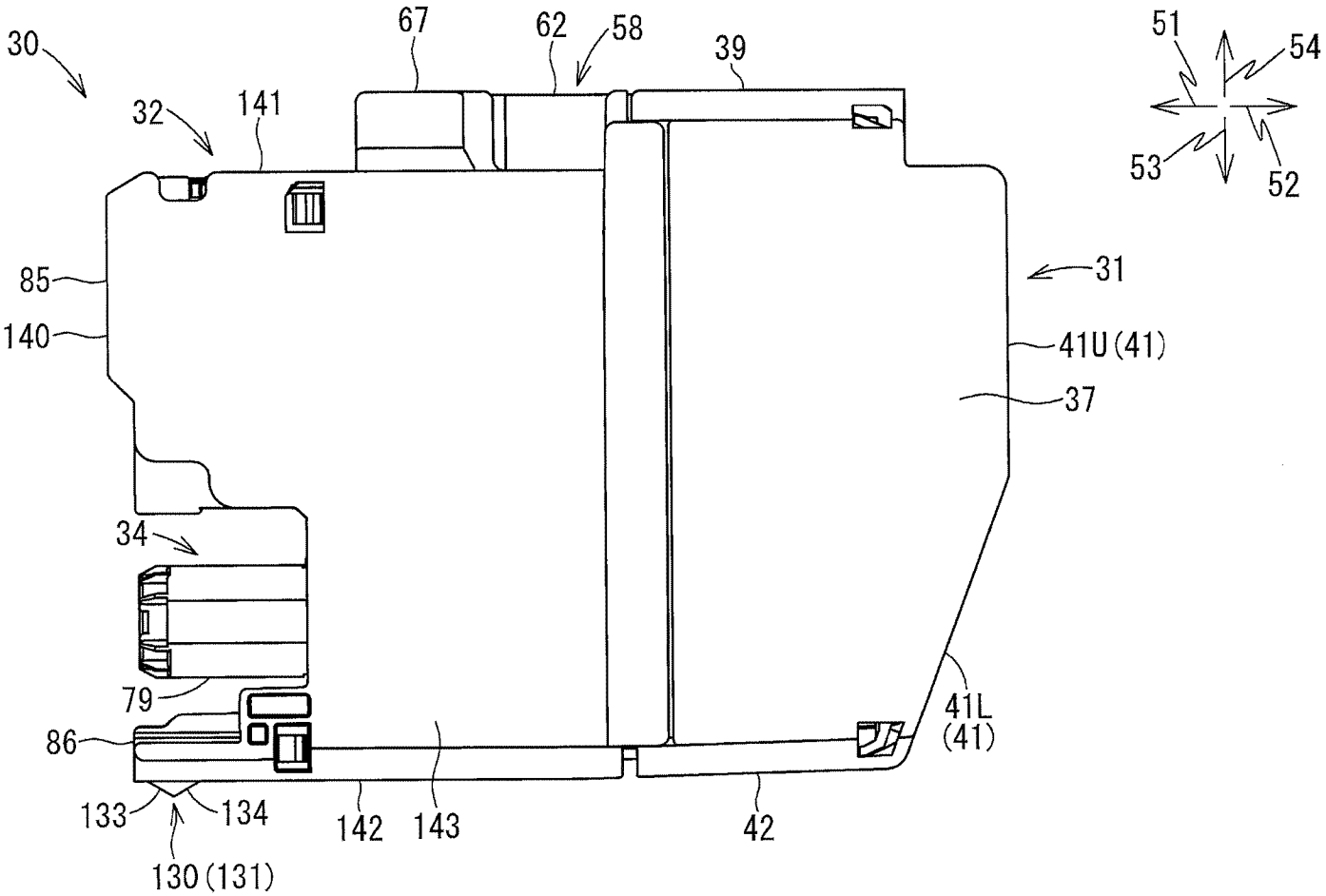
FIG. 5 is a side view of the ink cartridge according to the embodiment.

As illustrated in FIGS. 2 and 7, four contacts 106 (as an example of a contact) are disposed on the top wall of the case 101 at positions near the end wall of the case 101. The four contacts 106 protrude from a lower surface of the top wall downward toward the internal space of the case 101. Although not illustrated in detail in the drawings, the four contacts 106 are arranged to be spaced apart from one another in the right-left direction 55 and 56. The four contacts 106 are arranged each at a position corresponding to one of four electrodes 65 of the ink cartridge 30 as will be described later (see FIGS. 3A and 4A). Each contact 106 is formed of a material having electrical conductivity and resiliency. The contacts 106 are therefore upwardly resiliently deformable.

Note that, in the present embodiment, four sets of the four contacts 106 are disposed each set for each of the four ink cartridges 30 that can be mounted in the case 101. However, the number of contacts 106 and the number of electrodes 65 may be arbitrary.

Each contact 106 is electrically connected to an arithmetic-logic unit (not shown) via an electrical circuit. The arithmetic-logic unit may include a CPU, a ROM, and a RAM, for example, or may be configured as a controller of the printer 10. The contacts 106 are engaged with the corresponding electrodes 65 when the ink cartridge 30 is attached to the case 101. When engaged with the corresponding electrodes 65, the respective contacts 106 are electrically connected to the corresponding electrodes 65, so that: a voltage Vc is applied to the corresponding electrode 65; the corresponding electrode 65 is grounded; and power is supplied to the corresponding electrode 65. Due to establishment of the electrical connection between the contacts 106 and the electrodes 65, the data stored in an IC of the ink cartridge 30 is made electrically accessible. Outputs from the electrical circuits are configured to be inputted into the arithmetic-logic unit.

<Rod 125>

As illustrated in FIGS. 2 and 7, a rod 125 is provided at the end wall of the case 101 at a position above the ink needle 102. The rod 125 protrudes rearward from the end wall of the case 101. The rod 125 is shaped like an upper half portion of a cylinder. That is, as shown in FIG. 2, the rod 125 has an inverted U-shape in cross-section taken along a plane perpendicular to the front-rear direction 51 and 52. The rod 125 has a rib that protrudes upward from an uppermost portion of the inverted U-shape. The rib extends in the front-rear direction 51 and 52. In a state where the ink cartridge 30 is attached to the cartridge-attachment section 110, that is, when the ink cartridge 30 is in in an attached state, the rod 125 is received in a recess 96 (described later) of the attached ink cartridge 30.

<Residual-Amount Sensor 103>

As illustrated in FIG. 7, the residual-amount sensor 103 (as an example of a sensor) is disposed at the top wall of the case 101 at a position rearward of the contacts 106. The residual-amount sensor 103 includes a light-emitting portion and a light-receiving portion. The light-emitting portion and the light-receiving portion are arranged to oppose and to be spaced apart from each other in the right-left direction 55 and 56. When the ink cartridge 30 is attached to the cartridge-attachment section 110, a housing 62 (described later) of the ink cartridge 30 is disposed between the light-emitting portion and the light-receiving portion of the residual-amount sensor 103. In other words, the light-emitting portion and the light-receiving portion are arranged to oppose each other with the housing 62 of the attached ink cartridge 30 interposed therebetween.

The light-emitting portion is configured to emit light in the right-left direction 55 and 56, and the light-receiving portion is configured to receive the light emitted from the light-emitting portion. The residual-amount sensor 103 is configured to output different detection signals depending on whether the light emitted from the light-emitting portion is received by the light-receiving portion. For example, the residual-amount sensor 103 outputs a low-level signal (a signal whose level is less than a threshold level) when the light emitted from the light-emitting portion is not received by the light-receiving portion (i.e., when an intensity of the light received at the light-receiving portion is less than a predetermined intensity). On the other hand, the residual-amount sensor 103 outputs a high-level signal (a signal whose level is equal to or greater than the threshold level) when the light emitted from the light-emitting portion is received by the light-receiving portion (i.e., when the intensity of the light received at the light-receiving portion is equal to or greater than the predetermined intensity).

<Attachment Sensor 113>

As illustrated in FIG. 7, the attachment sensor 113 is also disposed at the top wall of the case 101. Specifically, the attachment sensor 113 is disposed at a position frontward of the residual-amount sensor 103 but rearward of the contacts 106. The attachment sensor 113 includes a light-emitting portion and a light-receiving portion. The light-emitting portion is arranged to oppose the light-receiving portion and is spaced apart from the light-receiving portion in the right-left direction 55 and 56. When the ink cartridge 30 is attached to the cartridge-attachment section 110, a light-blocking plate 67 of the attached ink cartridge 30 is located between the light-emitting portion and the light-receiving portion of the attachment sensor 113. In other words, the light-emitting portion and the light-receiving portion are arranged to oppose each other with the light-blocking plate 67 of the mounted ink cartridge 30 interposed therebetween.

The attachment sensor 113 is configured to output different detection signals depending on whether or not light emitted in the right-left direction 55 and 56 from the light-emitting portion is received by the light-receiving portion. For example, the attachment sensor 113 outputs a low-level signal when the light emitted from the light-emitting portion is not received at the light-receiving portion (that is, when an intensity of the light received at the light-receiving portion is less than a predetermined intensity). On the other hand, the attachment sensor 113 outputs a high-level signal when the light emitted from the light-emitting portion is received by the light-receiving portion (that is, when the intensity of the received light is equal to or greater than the predetermined intensity).

<Ink Cartridge 30>

The ink cartridge 30 shown in FIGS. 3A to 5 is a container configured to store ink therein. The ink cartridge 30 defines an inner space therein serving as the ink chamber 36 configured to store ink (see FIG. 1). The ink chamber 36 (as an example of a liquid chamber) is formed by an inner frame 35. The inner frame 35 is a frame accommodated in a rear cover 31 and a front cover 32. That is, the rear cover 31 and front cover 32 constitute an outer shell of the ink cartridge 30. The front cover 32, the rear cover 31 and the inner frame 35 are an example of a cartridge body.

The posture of the ink cartridge 30 illustrated in FIGS. 3A to 6 is a posture when the ink cartridge 30 is in the attached state. Specifically, as will be described later, the ink cartridge 30 includes a front wall 140, a rear wall 41, top walls 39 and 141, and bottom walls 42 and 142. When the ink cartridge 30 is in the posture shown in FIGS. 3A to 6 (i.e., in the attached state), a direction from the rear wall 41 toward the front wall 140 coincides with the frontward direction 51; a direction from the front wall 140 toward the rear wall 41 coincides with the rearward direction 52; a direction from the top walls 39 and 141 toward the bottom walls 42 and 142 coincides with the downward direction 53, and a direction from the bottom walls 42 and 142 toward the top walls 39 and 141 coincides with the upward direction 54.

In the attached state of the ink cartridge 30, the front wall 140 faces frontward or faces in the frontward direction 51. The rear wall 41 is positioned spaced rearward of and away from the front wall 140. The top walls 39 and 141 are positioned between the front wall 140 and the rear wall 41. The bottom walls 42 and 142 are positioned below and away from the top walls 39 and 141, respectively. The bottom walls 42 and 142 are positioned between the front wall 140 and the rear wall 41.

When the ink cartridge 30 is attached to the cartridge-attachment section 110, the front wall 140 faces frontward, the rear wall 41 faces rearward, the bottom walls 42 and 142 face downward, and the top walls 39 and 141 face upward. More specifically, in the attached state of the ink cartridge 30, a front surface of the front wall 140 faces frontward, a rear surface of the rear wall 41 faces rearward, bottom surfaces of the bottom walls 42 and 142 face downward, and top surfaces of the top walls 39 and 141 face upward.

As illustrated in FIGS. 3A to 6, the ink cartridge 30 includes the rear cover 31, the front cover 32, and the inner frame 35 defining the ink chamber 36. The rear cover 31 has a substantially rectangular parallelepiped shape. The front cover 32 has a substantially rectangular parallelepiped shape. The rear cover 31 includes the rear wall 41. The front cover 32 includes the front wall 140. The front cover 32 is assembled to the rear cover 31 to form the outer shell of the ink cartridge 30. The inner frame 35 is accommodated in the rear cover 31 and the front cover 32 assembled to each other.

In the attached state, the ink cartridge 30 extends in the front-rear direction 51 and 52, in the up-down direction 53 and 54, and in the right-left direction 55 and 56. The ink cartridge 30 has a generally flat shape having a height in the up-down direction 53 and 54 (in the gravitational direction), a width in the right-left direction 55 and 56, and a depth in the front-rear direction 51 and 52, the width being smaller than the height and the depth. A surface of the front cover 32 facing in an insertion direction (i.e., in the frontward direction 51) when the ink cartridge 30 is inserted into the cartridge-attachment section 110 is the front surface of the front wall 140. A surface of the rear cover 31 facing in a removal direction (i.e., in the rearward direction 52) when the ink cartridge 30 is removed from the cartridge-attachment section 110 is the rear surface of the rear wall 41. That is, the rear wall 41 is disposed to oppose the front wall 140 such that the ink chamber 36 is interposed between the front wall 140 and the rear wall 41.

<Rear Cover 31>

As illustrated in FIGS. 3A to 4B, the rear cover 31 includes the rear wall 41, side walls 37 and 38, a top wall 39, and a bottom wall 42. The side walls 37 and 38 are disposed spaced apart from each other in the right-left direction 55 and 56. The top wall 39 and the bottom wall 42 are disposed spaced apart from each other in the up-down direction 53 and 54, and extend frontward from the rear wall 41. That is, the rear cover 31 has a box-like shape formed with an opening that is open frontward. The inner frame 35 is inserted into the rear cover 31 via this opening. In other words, the rear cover 31 covers a rear portion of the inner frame 35. In a state where the inner frame 35 is inserted in the rear cover 31, the ink chamber 36 is arranged to be interposed between the top wall 39 and the bottom wall 42. In other words, in the attached state of the ink cartridge 30, the ink chamber 36 is positioned between the front wall 140 (the front surface of the front wall 140) and the rear wall 41 (the rear surface of the rear wall 41).

The rear wall 41 includes an upper portion 41U and a lower portion 41L. The upper portion 41U is arranged above the lower portion 41L. The lower portion 41L is positioned frontward relative to the upper portion 41U. Specifically, the upper portion 41U and the lower portion 41L are both planar shaped, and intersect each other but are not perpendicular to each other. Specifically, the lower portion 41L is inclined relative to the up-down direction 53 and 54 such that the lower portion 41L extends closer to the front wall 140 as extending toward the bottom wall 42. Although not illustrated in the drawings, a sheet prompting a user to push the upper portion 41U is attached to the upper portion 41U. The sheet may include a text such as "PUSH," a sign such as an arrow, or a figure indicating pushing with a finger.

Incidentally, the rear wall 41 may not include the lower portion 41L and may be configured solely of the upper portion 41U. That is, a lower end of the upper portion 41U may be connected to a rear end of the bottom wall 42 of the rear cover 31.

<Front Cover 32>

As illustrated in FIGS. 3A to 4B, the front cover 32 includes the front wall 140, side walls 143 and 144, a top wall 141 and a bottom wall 142. The side walls 143 and 144 are disposed spaced apart from each other in the right-left direction 55 and 56. The top wall 141 and the bottom wall 142 are disposed spaced apart from each other in the up-down direction 53 and 54, and extend rearward from the front wall 140. That is, the front cover 32 has a box shape formed with an opening that is open rearward. The inner frame 35 is inserted into the front cover 32 via the opening. That is, the front cover 32 covers a front portion of the inner frame 35 that is not covered with the rear cover 31.

In a state where the front cover 32 and the rear cover 31 are assembled to each other, that is, in a state where assembly of the ink cartridge 30 is completed, the top wall 141 of the front cover 32 and the top wall 39 of the rear cover 31 constitute a top wall of the ink cartridge 30; the bottom wall 142 of the front cover 32 and the bottom wall 42 of the rear cover 31 constitute a bottom wall of the ink cartridge 30; and the side walls 143 and 144 of the front cover 32 and the side walls 37 and 38 of the rear cover 31 constitute side walls of the ink cartridge 30.

That is, in the assembled ink cartridge 30, a top surface of the top wall 141 and a top surface of the top wall 39 constitute a top surface (upper surface) of the ink cartridge 30; a bottom surface of the bottom wall 142 and a bottom surface of the bottom wall 42 constitute a bottom surface of the ink cartridge 30; and outer surfaces of the side walls 143 and 144 and outer surfaces of the side walls 37 and 38 constitute side surfaces of the ink cartridge 30.

Further, in the state where the ink cartridge 30 is assembled, the front wall 140 of the front cover 32 constitutes a front wall of the ink cartridge 30, whereas the rear wall 41 of the rear cover 31 constitutes a rear wall of the ink cartridge 30. The front wall of the ink cartridge 30 (front wall 140 of the front cover 32) and the rear wall of the ink cartridge 30 (rear wall 41 of the rear cover 31) are arranged spaced apart from each other in the front-rear direction 51 and 52. That is, in the attached posture, the front surface of the front surface 140 constitutes a front surface of the ink cartridge 30; the rear surface of the rear wall 41 constitutes a rear surface of the rear wall of the ink cartridge 30.

Incidentally, the front surface, rear surface, top surface, bottom surface, and side surfaces constituting the ink cartridge 30 need not be configured as one flat plane, respectively. That is, the front surface of the ink cartridge 30 can be any surface(s) that can be seen when the ink cartridge 30 in its attached posture is viewed from its front side, and that is (are) positioned frontward relative to a center of the ink cartridge 30 in the front-rear direction 51 and 52. The rear surface of the ink cartridge 30 can be any surface(s) that can be seen when the ink cartridge 30 in its attached posture is viewed from its rear side, and that is(are) positioned rearward relative to the front-rear center of the ink cartridge 30. The upper surface of the ink cartridge 30 can be any surface(s) that can be seen when the ink cartridge 30 in its attached posture is viewed from above, and that is(are) positioned upward relative to a center of the ink cartridge 30 in the up-down direction 53 and 54. The lower surface of the ink cartridge 30 can be any surface(s) that can be seen when the ink cartridge 30 in its attached posture is viewed from below, and that is positioned downward relative to the center of the ink cartridge 30 in the up-down direction 53 and 54. The same is applied to the side surfaces.

The front wall 140 includes a first protruding portion 85 and a second protruding portion 86. The first protruding portion 85 protrudes frontward from an upper end portion of the front cover 32 to constitute an upper end portion of the front wall 140. The first protruding portion 85 has a front end constituting a part of the front surface of the front wall 140. The second protruding portion 86 protrudes frontward from a lower end portion of the front cover 32 to constitute a lower end portion of the front wall 140. The second protruding portion 86 is positioned below the ink supply portion 34.

The recess 96 is formed in the front end of the first protruding portion 85. That is, the recess 96 is formed in the upper end portion of the front wall 140 of the front cover 32. The recess 96 is recessed rearward relative to the front surface of the front wall 140. The recess 96 is adapted to receive the rod 125 therein when the ink cartridge 30 is attached to the cartridge-attachment section 110. Accordingly, the recess 96 has a cross-sectional shape in conformance with a cross-sectional shape of the rod 125 taken along a plane perpendicular to the front-rear direction 51 and 52.

A through-hole 97 is formed in a lower end portion of the front wall 140 to penetrate the same in the front-rear direction 51 and 52. When the inner frame 35 is inserted in the front cover 32, the ink supply portion 34 provided at the inner frame 35 is exposed outside through the through-hole 97. Accordingly, the through-hole 97 is formed at a position, with a size and a shape corresponding to those of the ink supply portion 34 of the inner frame 35.

Further, a through-hole 98 is formed in the top wall 141 of the front cover 32. The through-hole 98 penetrates the top wall 141 in the up-down direction 53 and 54. The through-hole 98 serves as a hole for exposing the housing 62 (described later) protruding from an upper wall of the inner frame 35 to the outside when the inner frame 35 is accommodated in the front cover 32. Accordingly, the through-hole 98 is formed in the top wall 141 at a position, with a size and a shape corresponding to those of the housing 62.

The light-blocking plate 67 is provided at the top wall 141 (top surface of the top wall 141) of the front cover 32 to protrude upward therefrom. The light-blocking plate 67 extends in the front-rear direction 51 and 52. The light-blocking plate 67 is positioned frontward of the housing 62 protruding from the upper wall of the inner frame 35. The light-blocking plate 67 is disposed rearward of an IC board 64 (described later) provided on the top wall 141.

The light-blocking plate 67 is configured to block the light of the attachment sensor 113 traveling in the right-left direction 55 and 56. More specifically, when the ink cartridge 30 is attached to the cartridge-attachment section 110, the light emitted from the light-emitting portion of the attachment sensor 113 is incident on the light-blocking plate 67 before arriving at the light-receiving portion. As a result, the intensity of light received at the light-receiving portion is less than a predetermined intensity, for example, zero. Note that the light-blocking plate 67 may completely block the light traveling in the right-left direction 55 and 56, or may partially attenuate the light, may refract the light to change a traveling direction thereof, or may fully reflect the light.

On the top wall 141 of the front cover 32, the IC board 64 (an example of an electrical interface) is also disposed. The IC board 64 is positioned above the first protruding portion 85, that is, above the ink supply portion 34. The IC board 64 is a hard plate-shaped rigid board made of glass epoxy. The IC board 64 is electrically connected to the corresponding four contacts 106 (see FIG. 2) arranged in the right-left direction 55 and 56 during insertion of the ink cartridge 30 into the cartridge-attachment section 110, as well as when the ink cartridge 30 is attached to the cartridge-attachment section 110.

An IC (not shown) and four electrodes 65 are mounted on the IC board 64. The IC is a semiconductor integrated circuit and readably stores data indicating information on the ink cartridge 30, such as a lot number, a production date, and a color of the ink.

The electrodes 65 are electrically connected to the IC. The four electrodes 65 are arranged spaced apart from one another in the right-left direction 55 and 56. Each electrode 65 extends in the front-rear direction 51 and 52. The four electrodes 65 are arranged on an upper surface of the IC board 64 such that the electrodes 65 are exposed above to allow electrically access thereto from above.

<Engaging Portion 130>

Figure 6:
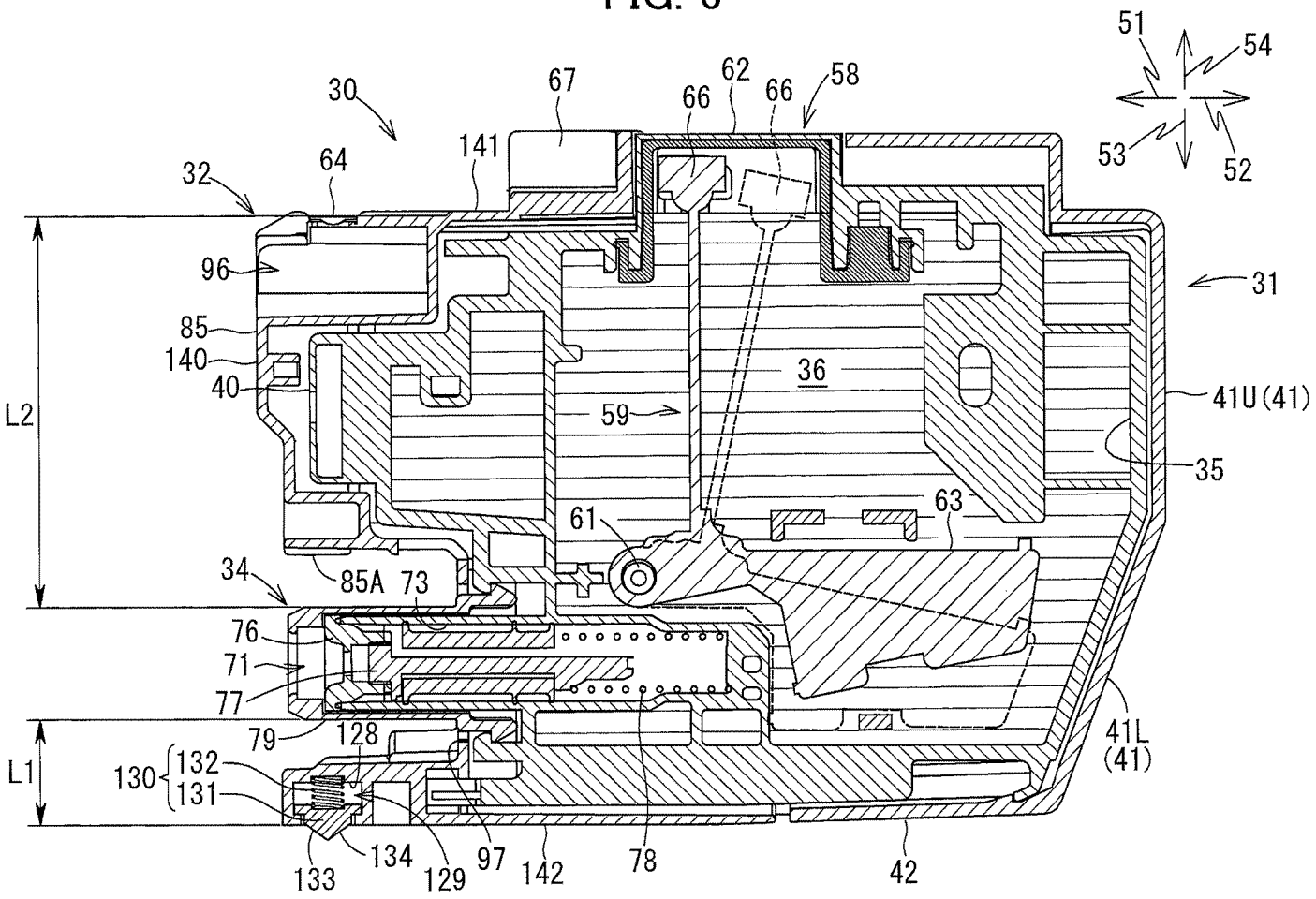
FIG. 6 is a vertical cross-sectional view illustrating an internal configuration of the ink cartridge according to the embodiment.

As illustrated in FIG. 6, a depression 129 is formed in the bottom wall 142 of the front cover 32 to be recessed upward therefrom. In the depression 129, the engaging portion 130 is disposed. The engaging portion 130 is positioned frontward relative to the housing 62 of a residual-amount detection portion 58 (described later). Note that, if the bottom wall 42 were formed to extend further frontward beyond a light-blocking portion 66 (described later), the depression 129 may be formed in this bottom wall 42, rather than the bottom wall 142.

The engaging portion 130 includes a protrusion 131 and a coil spring 132 (as an example of first urging member).

The protrusion 131 has a surface 133 and a surface 134. Both of the surfaces 133 and 134 are sloped relative to the bottom surface of the ink cartridge 30 (i.e., bottom surfaces of the bottom walls 142 and 42). More specifically, the surface 133 is inclined relative to the front-rear direction 51 and 52 such that: an upper edge thereof is positioned frontward relative to a lower edge thereof; and the surface 133 faces frontward and downward. The surface 133 is an example of a second sloped surface. The surface 134 is positioned rearward of the surface 133. The surface 134 is inclined relative to the front-rear direction 51 and 52 such that: an upper edge thereof is positioned rearward of a lower end thereof; and the surface 134 faces rearward and downward. The surface 134 is an example of a first sloped surface and an example of an engaging surface.

The coil spring 132 is connected to a ceiling surface 128 defining the depression 129 and to the protrusion 131. Specifically, the coil spring 132 has an upper end connected to the ceiling surface 128, and a lower end connected to the protrusion 131.

With the protrusion 131 connected to the coil spring 132, the surfaces 133 and 134 of the protrusion 131 can protrude downward relative to the depression 129. That is, the surfaces 133 and 134 protrude downward relative to the bottom wall 142 of the front cover 32 when no external force is applied to the protrusion 131.

The surfaces 133 and 134 of the protrusion 131 can be received in the depression 129 when the coil spring 132 is compressed. At this time, the coil spring 132 urges the protrusion 131 downward. Further, the surfaces 133 and 134 of the protrusion 131 are located below the depression 129 when the coil spring 132 has a natural length, as described above. That is, the protrusion 131 can move in the up-down direction 53 and 54 by contraction and expansion of the coil spring 132.

<Inner Frame 35>

Although not illustrated in the drawings, the inner frame 35 is formed in a generally annular shape, with a pair of side surfaces in the right-left direction 55 and 56 is opened. as described above. The respective open surfaces of the inner frame 35 are sealed with films (not illustrated) to form the ink chamber 36 for storing ink in the inner frame 35. The inner frame 35 includes a front wall 40 that defines a part of the ink chamber 36. The front wall 40 faces the front wall 140 of the front cover 32 when the inner frame 35 is accommodated in the front cover 32. More specifically, a front surface of the front wall 40 faces a rear surface (opposite the front surface) of the front wall 140 when the inner frame 35 is accommodated in the front cover 32. The ink supply portion 34 is disposed at the front wall 40.

<Ink Supply Portion 34>

As illustrated in FIG. 6, the ink supply portion 34 (as an example of a liquid supply portion) protrudes frontward from the front wall 40 of the inner frame 35. The ink supply portion 34 has a cylindrical outer shape, and protrudes outward through the through-hole 97 formed in the front wall 140 of the front cover 32. That is, the ink supply portion 34 is positioned at the lower end portion of the front wall 140. Specifically, the ink supply portion 34 and the bottom wall 142 define therebetween a distance L1 in the up-down direction 53 and 54 that is smaller than a distance L2 defined between the ink supply portion 34 and the top wall 141 in the up-down direction 53 and 54. The distance L1 is an example of a first distance, whereas the distance L2 is an example of a second distance.

The ink supply portion 34 includes a cylindrical-shaped tubular wall 73 defining an internal space therein, a sealing member 76 and a cap 79. The sealing member 76 and cap 79 are attached to the tubular wall 73.

The tubular wall 73 extends to connect the interior and exterior of the ink chamber 36. The tubular wall 73 has a rear end that is opened in the ink chamber 36. The tubular wall 73 has a front end that is opened to the outside of the ink cartridge 30. Accordingly, the tubular wall 73 provides fluid communication between the ink chamber 36 and the outside of the ink cartridge 30 through the internal space of the tubular wall 73. The ink supply portion 34 can thus supply the ink stored in the ink chamber 36 to the outside of the ink cartridge 30 via the internal space of the tubular wall 73. The sealing member 76 and the cap 79 are attached to the front end of the tubular wall 73.

In the internal space of the tubular wall 73, a valve 77 and a coil spring 78 are accommodated. The valve 77 and the coil spring 78 serve to selectively switch states of the ink supply portion 34 between a state shown in FIG. 9 and a state shown in FIG. 6. That is, in the state shown in FIG. 9, the ink is allowed to flow out of the ink chamber 36 to the outside of the ink cartridge 30 via the internal space of the tubular wall 73. In the state shown in FIG. 6, the ink is not allowed to flow out of the internal space of the tubular wall 73 to the outside of the ink cartridge 30.

The valve 77 is movable in the front-rear direction 51 and 52 to open and close the ink supply port 71 formed at a center of the sealing member 76. The coil spring 78 biases the valve 77 frontward. Accordingly, without application of an external force, the valve 77 closes the ink supply port 71 of the sealing member 76. The ink supply port 71 is an example of a liquid outlet. The valve 77 and the coil spring 78 are an example of a valve and an example of a second urging member.

The sealing member 76 is attached to the front end of the tubular wall 73. The sealing member 76 is formed of an elastic material such as rubber or elastomer. The sealing member 76 is a disc-like shaped and has a center portion in which a through-hole is formed. The through-hole penetrates through the center portion of the sealing member 76 in the front-rear direction 51 and 52 to provide a tubular-shaped inner circumferential surface that defines the ink supply port 71. The ink supply port 71 has a diameter that is slightly smaller than an outer diameter of the ink needle 102. The cap 79 is externally fitted to the tubular wall 73, with the sealing member 76 attached to the front end of the tubular wall 73, such that the sealing member 76 is in liquid-tight contact with the front end of the tubular wall 73.

When the ink cartridge 30 is inserted into the cartridge-attachment section 110 in a state where the valve 77 closes the ink supply port 71, the ink needle 102 enters into the ink supply port 71. An outer circumferential surface of the ink needle 102 is brought into contact with the inner circumferential surface defining the ink supply port 71 to provide a liquid-tight seal therewith, while elastically deforming the sealing member 76. When the tip of the ink needle 102 moves past the sealing member 76 and enters into the internal space of the tubular wall 73, the ink needle 102 comes in contact with the valve 77. As the ink cartridge 30 is further inserted into the cartridge-attachment section 110, the ink needle 102 moves the valve 77 rearward against a biasing force of the coil spring 78, thereby opening the ink supply port 71. Accordingly, the ink stored in the ink chamber 36 can flow into a tip portion of the ink needle 102 via the internal space of the tubular wall 73. Although not illustrated in the drawings, ink flows from the internal space of the tubular wall 73 into the internal space of the ink needle 102 via through-holes formed in the tip portion of the ink needle 102. Accordingly, the ink stored in the ink chamber 36 can flow outside the ink cartridge 30 through the internal space of the tubular wall 73 and through the ink needle 102.

The ink supply portion 34 may not be provided with the valve 77 for closing the ink supply port 71. Instead, for example, the ink supply port 71 may be closed with a film. In this case, the ink needle 102 may break through the film at the time of insertion of the ink cartridge 30 into the cartridge-attachment section 110, thereby allowing the tip portion of the ink needle 102 to enter inside the internal space of the tubular wall 73 through the ink supply port 71. Still alternatively, the ink supply port 71 may be closed with an elastic force of the sealing member 76 itself. In this case, the ink supply port 71 may be pushed and enlarged by the ink needle 102 only when the ink needle 102 is inserted in the ink supply port 71.

<Residual-Amount Detection Portion 58>

The residual-amount detection portion 58 is configured to change a state of the light emitted from the outside of the ink cartridge 30 (i.e., from the residual-amount sensor 103 of the cartridge-attachment section 110) depending on the states of the ink cartridge 30 (i.e., an amount of residual ink in the ink cartridge 30). The residual-amount detection portion 58 is an example of a detection portion.

As illustrated in FIG. 6, the residual-amount detection portion 58 includes the housing 62 and a sensor arm 59.

The housing 62 protrudes upward from the upper wall of the inner frame 35. The housing 62 is exposed to the outside through the through-hole 98 formed in the front cover 32 such that the housing 62 protrudes upward relative to the top wall 141 of the front cover 32. The housing 62 defines an internal space therein that is in communication with the ink chamber 36. The housing 62 can allow light to pass therethrough in the right-left direction 55 and 56. That is, the housing 62 has light transmission capability.

The sensor arm 59 is disposed in the ink chamber 36 of the inner frame 35. The sensor arm 59 is supported by a pivot shaft 61 extending in the right-left direction 55 and 56. The sensor arm 59 is pivotably movable about the pivot shaft 61. The sensor arm 59 includes a float 63, and the light-blocking portion 66 (an example of a light-receiving portion.).

The float 63 has a specific gravity smaller than a specific gravity of the ink stored in the ink chamber 36. Accordingly, in the ink chamber 36, buoyancy is generated on the float 63 as long as the float 63 is in the ink. In other words, in a state where the ink chamber 36 is almost filled with the ink, the sensor arm 59 is urged to pivot counterclockwise in FIG. 6 due to the buoyancy generated on the float 63. Hereinafter, the ink chamber 36 is assumed to be filled with ink and the sensor arm 59 is assumed to be in a posture indicated by a sold line in FIG. 6.

The light-blocking portion 66 is plate-shaped. The light-blocking portion 66 is disposed in the housing 62 of the inner frame 35. Specifically, the light-blocking portion 66 is located higher relative to the top wall 141 of the front cover 32. Since the sensor arm 59 is urged to pivot counterclockwise in FIG. 6, the light-blocking portion 66 is in contact with a wall defining a front end of the housing 62. Due to this contact, the sensor arm 59 is maintained in the posture indicated by the solid line shown in FIG. 6. In this state shown in FIG. 6, the light-blocking portion 66 blocks the light from the residual-amount sensor 103 traveling through the housing 62 in the right-left direction 55 and 56. The position of the light-blocking portion 66 at this time is referred to as a detection position (indicated by the solid line in FIG. 6).

More specifically, when the light emitted from the light-emitting portion of the residual-amount sensor 103 is incident on the light-blocking portion 66 before arriving at the light-receiving portion, the intensity of the received at the light-receiving portion is less than a predetermined intensity, for example, zero. Note that the light-blocking portion 66 may completely block the light traveling in the right-left direction 55 and 56, may partially attenuate the light, may refract the light to change a traveling direction thereof, or may totally reflect the light.

When the amount of ink decreases in the ink chamber 36 and a liquid surface of the ink becomes lower than the position of the float 63 indicated by the solid line in FIG. 6 (i.e., the position of the float 63 when the light-blocking portion 66 is at the detection position), the float 63 starts to move downward, following the declining liquid surface of the ink. In accordance with the downward movement of the float 63, the sensor arm 59 is pivoted clockwise in FIG. 6, thereby moving a part of the light-blocking portion 66 within the housing 62 out of an optical path formed by the light traveling from the light-emitting portion to the light-receiving portion at the residual-amount sensor 103. Accordingly, the intensity of the light received at the light-receiving portion of the residual-amount sensor 103 is equal to or greater than the predetermined intensity. The position of the light-blocking portion 66 at this time (the position indicated by a dotted line in FIG. 6) is a non-detection position that is different from the detection position.

<Attachment/Detachment of the Ink Cartridge 30 Relative to the Cartridge-Attachment Section 110>

Next, a process for attaching the ink cartridge 30 to the cartridge-attachment section 110 will be described.

As illustrated in FIG. 7, before the ink cartridge 30 is inserted into the cartridge-attachment section 110, the valve 77 closes off the ink supply port 71 of the sealing member 76. Accordingly, at this time, ink flow from the ink chamber 36 to the outside of the ink cartridge 30 is interrupted.

Also, as shown in FIG. 7, prior to attachment of the ink cartridge 30 to the cartridge-attachment section 110, nothing is located between the light-emitting portion and the light-receiving portion of the residual-amount sensor 103. The residual-amount sensor 103 therefore outputs a high-level signal to the controller of the printer 10. Likewise, since nothing is located between the light-emitting portion and the light-receiving portion of the attachment sensor 113, the attachment sensor 113 outputs a high-level signal to the controller of the printer 10.

For attaching the ink cartridge 30, the ink cartridge 30 is inserted into the case 101 of the cartridge-attachment section 110 through the opening 112, as shown in FIG. 7. Since the upper portion 41U of the rear wall 41 of the rear cover 31 is positioned rearward relative to the lower portion 41L of the rear wall 41, that is, since the upper portion 41U is positioned closer to the user than the lower portion 41L is to the user, the user can grip and push the upper portion 41U to insert the ink cartridge 30 frontward into the cartridge-attachment section 110.

As described above, the user is encouraged to push the upper portion 41U, due to the sheet attached to the upper portion 41U for prompting the user to push the upper portion 41U (such as a text such as "PUSH," a sign such as an arrow, or a figure illustrating pushing with a finger). At the time of insertion of the ink cartridge 30 into the case 101 of the cartridge-attachment section 110, a lower portion of the ink cartridge 30, that is, the lower portions of the front cover 32 and the rear cover 31, are inserted into the corresponding lower guide groove 109 formed in the case 101.

Also, upon insertion of the ink cartridge 30 into the case 101 of the cartridge-attachment section 110, the surface 133 of the protrusion 131 is brought into contact with a rear end of the bottom wall of the case 101. Accordingly, the surface 133 is pushed upward by the bottom wall constituting the case 101. The protrusion 131 is thus moved upward against the biasing force of the coil spring 132 to be received in the depression 129. As illustrated in FIG. 7, the protrusion 131 is supported from below by the bottom wall of the case 101.

As the ink cartridge 30 is further inserted frontward from the state shown in FIG. 7, the ink cartridge 30 reaches a state shown in FIG. 8. At this time, as illustrated in FIG. 8, the cap 79 of the ink supply portion 34 starts entering into the guide portion 105. The recess 96 of the front cover 32 faces the rod 125, and the rod 125 starts moving into the recess 96.

Further, the light-blocking plate 67 comes to a location between the light-emitting portion and the light-receiving portion of the residual-amount sensor 103. As a result, the residual-amount sensor 103 outputs a low-level signal, instead of the high-level signal, to the controller of the printer 10. That is, the signal outputted from the residual-amount sensor 103 is changed from high level to low level. On the other hand, the attachment sensor 113 continues to output the high-level signal to the controller of the printer 10.

Figure 9:
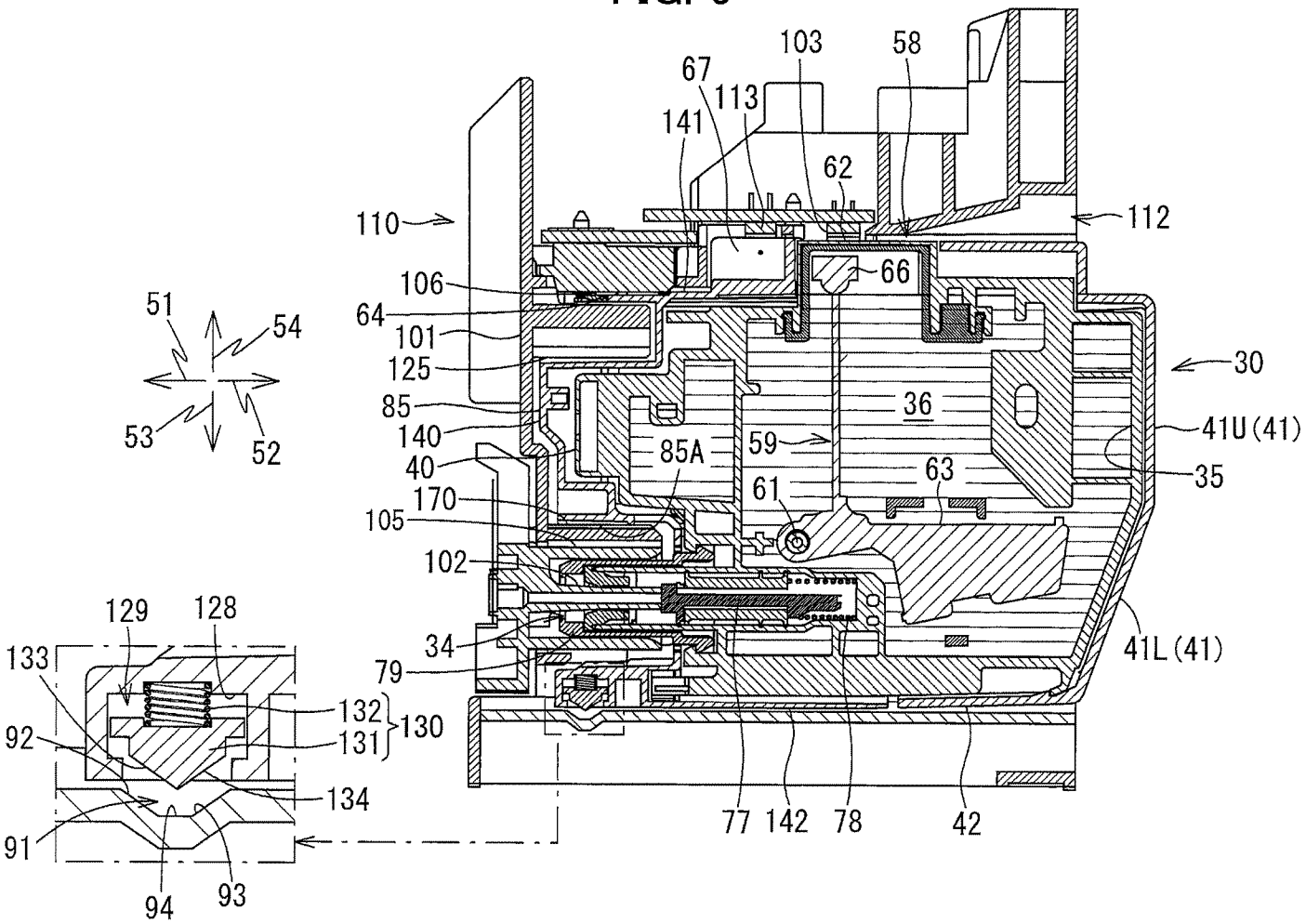
FIG. 9 is a vertical cross-sectional view illustrating the ink cartridge according to the embodiment and the cartridge-attachment section, and illustrating a state where: an ink needle of the cartridge-attachment section has entered an ink supply port of the ink supply portion; and an engaging portion of the ink cartridge is located vertically above a recess of the cartridge-attachment section.

As the ink cartridge 30 is further inserted frontward from the state shown in FIG. 8, the ink cartridge 30 reaches a state shown in FIG. 9. As shown in FIG. 9, the cap 79 of the ink supply portion 34 has entered in the guide portion 105 and the ink needle 102 has moved past the ink supply port 71 to separate the valve 77 from the sealing member 76 against the biasing force of the coil spring 78. The ink cartridge 30 is thus applied with the biasing force of the coil spring 78, by which biasing force the ink cartridge 30 is urged rearward.

Further, at this time, a bottom surface 85A of the first protruding portion 85 facing downward is supported by a surface 170 constituting the case 101 of the cartridge-attachment section 110, the surface 170 facing upward and being positioned above the guide portion 105. Due to this contact between the bottom surface 85A and the surface 170, the ink cartridge 30 is fixed in position in the up-down direction 53 and 54. Incidentally, the bottom surface 85A is arranged to overlap with the IC board 64 when the ink cartridge 30 is viewed from above. That is, the bottom surface 85A has a portion aligned with the IC board 64 in the up-down direction 53 and 54. Alternatively, instead of the surface 170, the rod 125 may function to support the attached ink cartridge 30 to provide positioning of the ink cartridge 30 in the up-down direction 53 and 54, for example.

In the state shown in FIG. 9, the rod 125 is located inside the recess 96 of the front cover 32 to support the front cover 32 from below. The IC board 64 has reached below the corresponding contacts 106, and the electrodes 65 are electrically connected to the contacts 106 while resiliently deforming the contacts 106 upward. At this time, the IC board 64 is urged downward by the resiliently deformed contacts 106. However, since the rod 125 supports the front cover 32 from below, the IC board 64 can be positioned accurately relative to the contacts 106. Here, the rod 125 may not necessarily support the front cover 32 from below. Rather, for example, some annular member provided around the ink needle 102 may contact the front cover 32 to support the front cover 32.

Further, in the state illustrated in FIG. 9, the light-blocking portion 66 is located between the light-emitting portion and the light-receiving portion of the residual-amount sensor 103. Therefore, the signal outputted from the residual-amount sensor 103 to the controller of the printer 10 is maintained at the low level. Also, the light-blocking plate 67 is located between the light-emitting portion and the light-receiving portion of the attachment sensor 113. The signal outputted from the attachment sensor 113 to the controller of the printer 10 is changed from the high level to the low level. Accordingly, the controller of the printer 10 determines that the ink cartridge 30 has been attached to the cartridge-attachment section 110.

Figure 10:
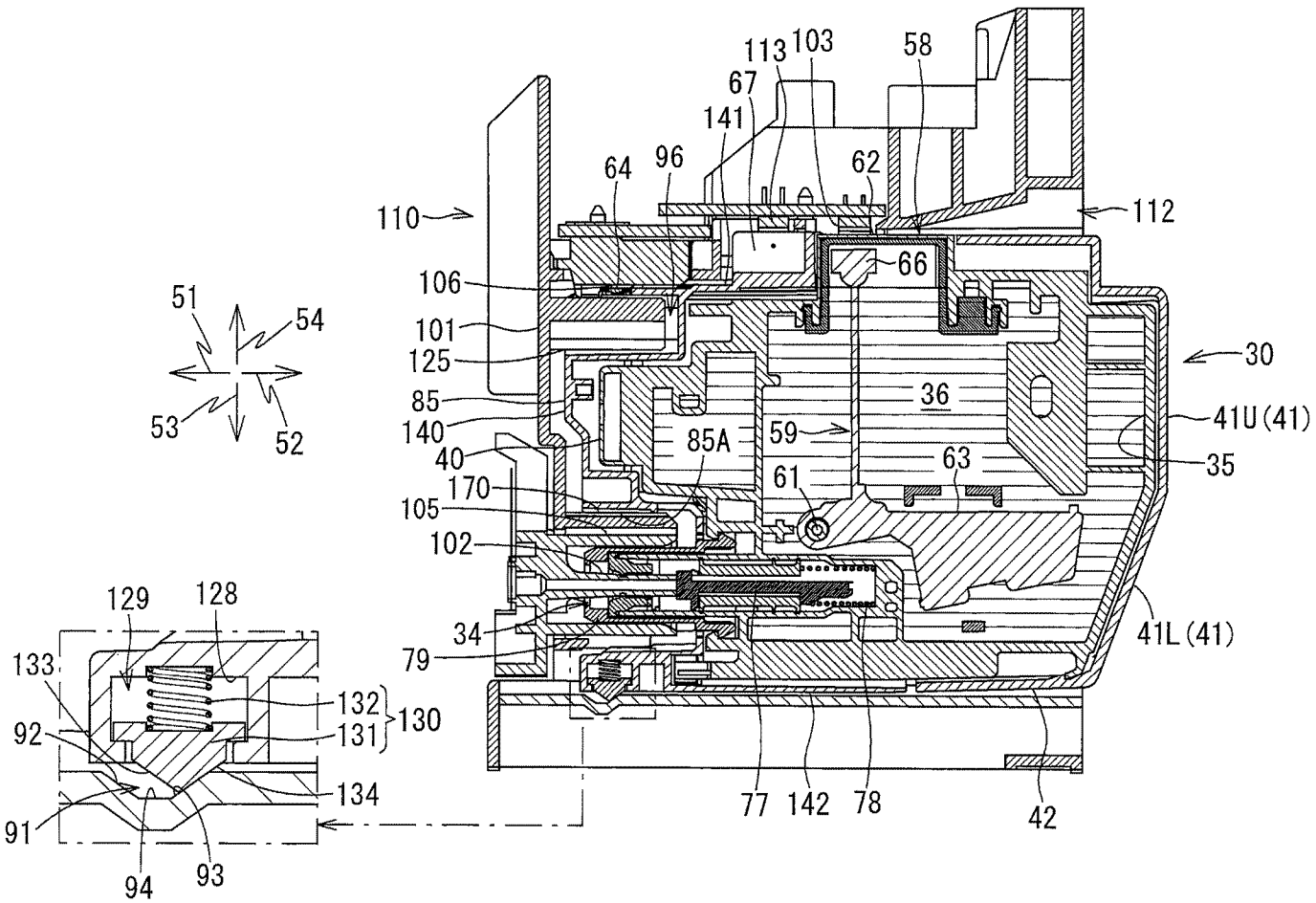
FIG. 10 is a vertical cross-sectional view illustrating the ink cartridge according to the embodiment and the cartridge-attachment section, and illustrating a state where: the ink needle is in the ink supply port of the ink supply portion; and the engaging portion is engaged with the recess of the cartridge-attachment section.

Further, in the state shown in FIG. 9, the engaging portion 130 is located vertically above the corresponding recess 91. That is, the protrusion 131 is no longer supported by the bottom wall constituting the case 101 of the cartridge-attachment section 110. Accordingly, as illustrated in FIG. 10, the protrusion 131 is moved downward by the biasing force of the coil spring 132 and received in the recess 91. Here, since the ink cartridge 30 is biased rearward by the coil spring 78, the surface 134 of the protrusion 131 comes into contact with the surface 93 of the recess 91 from its front side. That is, the surface 134 of the protrusion 131 and the surface 93 defining the recess 91 engage with each other. This engagement between the surface 134 and surface 93 can restrict the ink cartridge 30 from moving rearward due to the biasing force of the coil spring 78. That is, the ink cartridge 30 is fixed in position relative to the cartridge-attachment section 110, thereby completing attachment of the ink cartridge 30 to the cartridge-attachment section 110. At this time, the ink cartridge 30 is in the attached state.

As the ink flows out from the ink cartridge 30 in the attached state to the print head 21 and is consumed by the print head 21, the amount of ink stored in the ink chamber 36 decreases. In accordance with reduction in the amount of ink left in the ink chamber 36, the part of the light-blocking portion 66, which was located in the housing 62, is moved to a position offset from the optical path formed by the light from the light-emitting portion to the light-receiving portion of the residual-amount sensor 103. Accordingly, the signal outputted from the residual-amount sensor 103 is changed from the low level to the high level. The controller of the printer 10 therefore determines that the residual amount of ink in the ink chamber 36 becomes smaller.

Next, a process for removing the ink cartridge 30 in the attached state from the cartridge-attachment section 110 will be described.

When the user grasps and pulls the ink cartridge 30 in the attached state rearward, the surface 134 of the protrusion 131 of the engaging portion 130 presses the surface 93 of the recess 91 of the cartridge-attachment section 110 rearward. Accordingly, the protrusion 131 moves upward along the surface 93 against the biasing force of the coil spring 132 by a reaction force from the surface 93. As a result, as illustrated in FIG. 8, the protrusion 131, which has moved upward, is then supported by the bottom wall constituting the case 101 of the cartridge-attachment section 110. That is, the rearward movement of the ink cartridge 30 is no longer restricted. The ink cartridge 30 is thus allowed to move further rearward as the user withdraws the ink cartridge 30 rearward. The ink cartridge 30 is finally detached from the cartridge-attachment section 110.

When the ink cartridge 30 in the attached state is moved rearward, the light-blocking plate 67 is also moved rearward to be displaced from the position between the light-emitting portion and the light-receiving portion of the attachment sensor 113. Accordingly, the signal outputted from the attachment sensor 113 to the controller of the printer 10 is changed from the low level to the high level, thereby enabling the controller to detect that the ink cartridge 30 has been detached from the cartridge-attachment section 110.

Operational and Technical Advantages of the Embodiment

In the ink cartridge 30 according to the embodiment, the IC board 64 and the light-blocking portion 66 are provided on the top wall 141, while the engaging portion 130 is disposed on the bottom wall 142. That is, compared to a case where the IC board 64, light-blocking portion 66 and engaging portion 130 were all provided on the upper wall of the ink cartridge 30, a reduced number of members are placed on the upper wall (top walls 39 and 141) of the ink cartridge 30 in the present embodiment. As a result, this structure of the embodiment can provide an improved degree of freedom in arrangement of the IC board 64 and the light-blocking portion 66 on the upper wall of the ink cartridge 30.

When the attached ink cartridge 30 is fixed in position relative to the cartridge-attachment section 110 at the ink supply portion 34 as in the depicted embodiment, it is likely that the attached ink cartridge 30 may be applied with a force acting to pivotally move the ink cartridge 30 about the ink supply portion 34. However, in the depicted embodiment, the engaging portion 130 is provided closer to the ink supply portion 34 than the light-blocking portion 66 is to the ink supply portion 34 in the front-rear direction 51 and 52. This means that the surface 134 of the engaging portion 130 is positioned closer to the pivot center (ink supply portion 34) than the light-blocking portion 66 is to the pivot center in the front-rear direction 51 and 52. Accordingly, this configuration of the embodiment can reduce deviation in the position of the engaging portion 130 even if the ink cartridge 30 in the attached state were urged to pivot about the pivot center, compared to a configuration in which the surface 134 of the engaging portion 130 is positioned farther away from the pivot center of the ink cartridge 30 than the light-blocking portion 66 is from the pivot center. That is, the posture of the ink cartridge 30 in the attached state can be stabilized.

The farther the engaging portion 130 is located from the pivot center of the ink cartridge 30, the larger rotational moment is applied to the engaging portion 130. In this case, the surface 93 engaging with the engaging portion 130 is likely to suffer from creep deformation. However, since the engaging portion 130 is positioned closer to the pivot center of the ink cartridge 30 than the light-blocking portion 66 is to the pivot center in the front-rear direction 51 and 52 in the embodiment, creep deformation is less likely to occur at the surface 93 than if the engaging portion 130 were disposed farther away from the pivot center of the ink cartridge 30 than the light-blocking portion 66 is from the pivot center in the front-rear direction 51 and 52.

Further, according to the structure of the ink cartridge 30 of the embodiment, the ink supply portion 34 is disposed near the bottom wall 142 of the ink cartridge 30. That is, the engaging portion 130 provided on the bottom wall 142 is positioned adjacent to the ink supply portion 34 in the up-down direction 53 and 54. In other words, the engaging portion 130 is disposed close to the pivot center of the ink cartridge 30 in the up-down direction 53 and 54. Accordingly, this structure can stabilize the posture of the attached ink cartridge 30 and suppress occurrence of creep deformation at the surface 93 that is engageable with the engaging portion 130.

Further, during insertion of the ink cartridge 30 into the cartridge-attachment section 110, the inclined surface 134 of the protrusion 131 can be guided smoothly along the surface of the cartridge-attachment section 110 that engages the surface 134 (i.e., the surface 93 defining the recess 91). Accordingly, the engaging portion 130 can be smoothly engaged with the cartridge-attachment section 110.

Further, when the ink cartridge 30 is attached to the cartridge-attachment section 110, the engaging portion 130 is applied with an upward force opposite a downward force, as a reaction force to the downward force (the biasing force of the coil spring 132). By this upward reaction force, the ink cartridge 30 is urged upward. This means that the IC board 64 is also urged upward. In the embodiment, when the ink cartridge 30 is attached to the cartridge-attachment section 110, the contacts 106 are arranged at positions corresponding to the IC board 64 of the mounted ink cartridge 30 to establish electrical connection with the IC board 64. Accordingly, with the structure of the depicted embodiment, the IC board 64 of the attached ink cartridge 30 can be biased toward the contacts 106, thereby realizing reliable electrical connection between the IC board 64 and the contacts 106.

VARIATIONS AND MODIFICATIONS

In the above-described embodiment, the engaging portion 130 is configured of the protrusion 131 and the coil spring 132. The positioning of the ink cartridge 30 relative to the cartridge-attachment section 110 is realized by the engagement between the surface 134 of the protrusion 131 and the surface 93 of the recess 91 formed in the cartridge-attachment section 110. However, the positioning of the ink cartridge 30 relative to the cartridge-attachment section 110 may be provided by a mechanism different from that of the depicted configuration.

For example, the engaging portion 130 may be configured of a leaf spring. The leaf spring may have a tip end portion formed with the engaging surface configured to engage the surface 93 of the cartridge-attachment section 110. In this case, the ink cartridge 30 may be attached to and detached from the cartridge-attachment section 110 by the user moving the ink cartridge 30 in the front-rear direction 51 and 52, as in the depicted embodiment. That is, there is no need to pivot the ink cartridge 30 for attaching and detaching the ink cartridge 30 relative to the cartridge-attachment section 110, as in an example described next.

Figure 11:
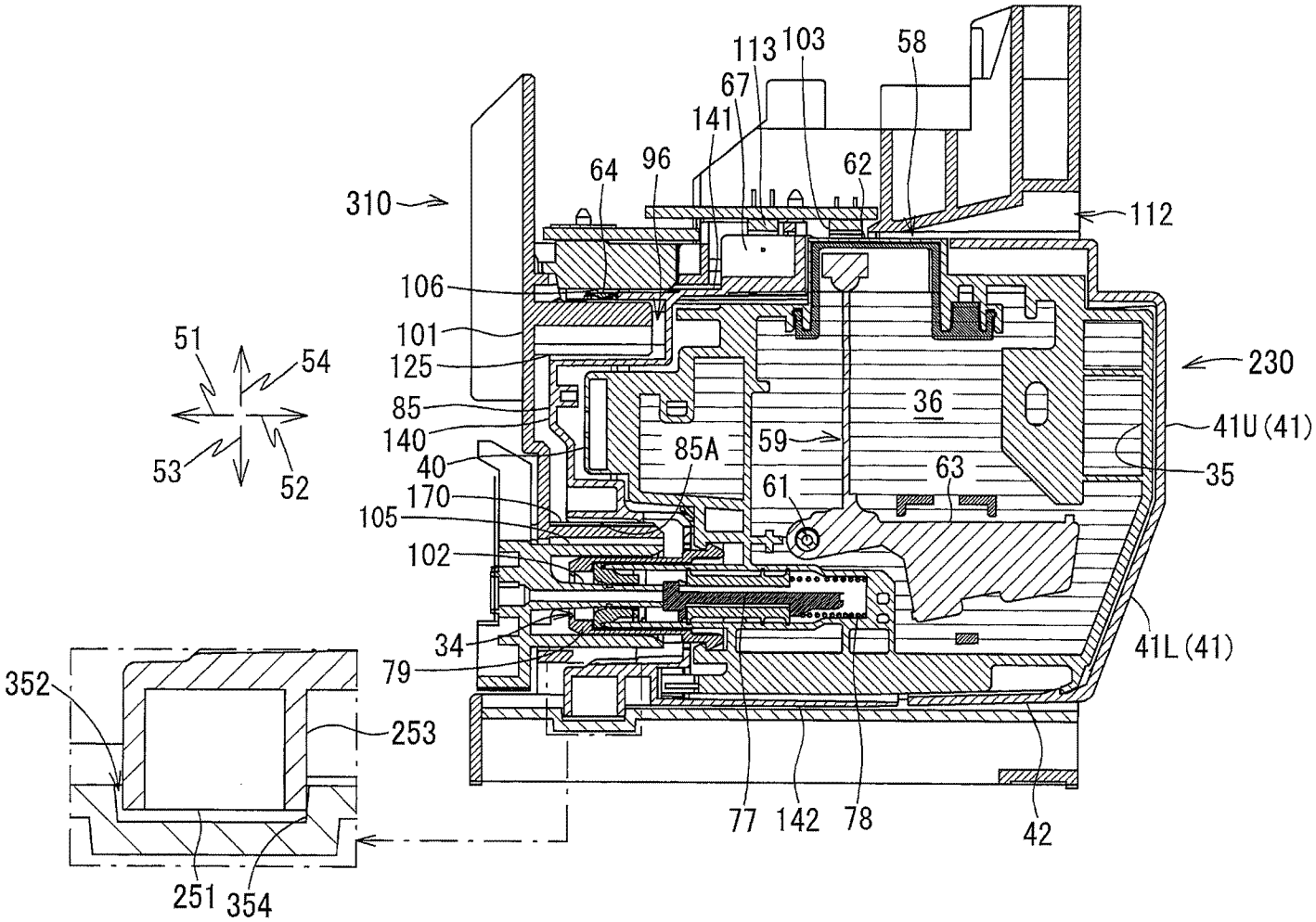
FIG. 11 a vertical cross-sectional view illustrating an ink cartridge according to a modification to the embodiment and the cartridge-attachment section, and illustrating a state where the ink cartridge is in a first posture.
Figure 12:
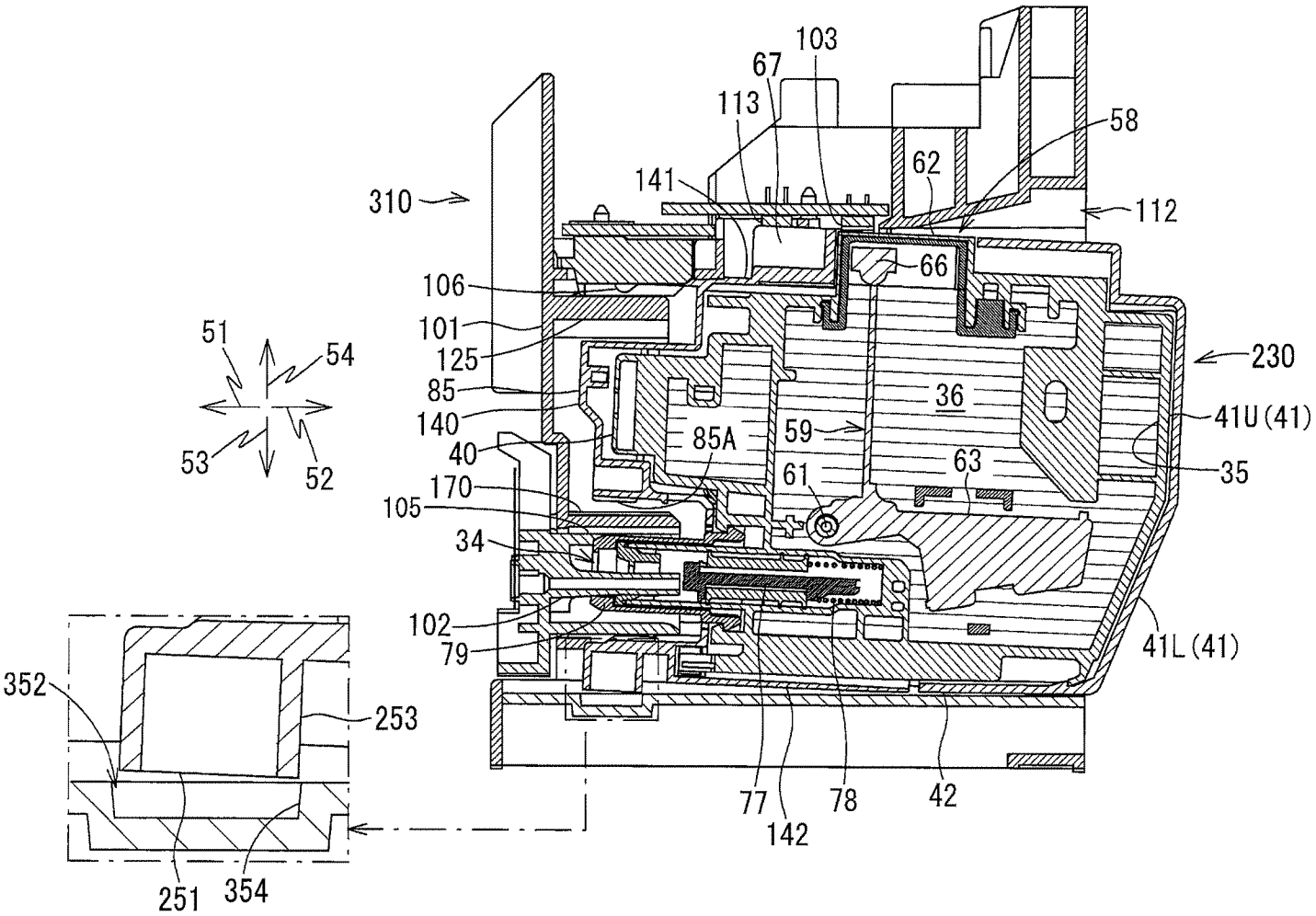
FIG. 12 is a vertical cross-sectional view illustrating the ink cartridge according to the modification and the cartridge-attachment section, and illustrating a state where the ink cartridge is in a second posture.

FIGS. 11 and 12 show an ink cartridge 230 according to a modification to the embodiment. Specifically, referring to FIG. 11, the ink cartridge 230 according to the modification includes a protrusion 251, instead of the engaging portion 130. The protrusion 251 protrudes downward from the bottom wall 142 of the ink cartridge 230. The protrusion 251 has a rear surface 253 that faces rearward. The protrusion 251 is another example of the engaging portion. A cartridge-attachment section 310 according to the modification includes a bottom wall in which a recess 352 is formed. The recess 352 has a rear edge that is defined by a surface 354 facing frontward.

The ink cartridge 230 is retained in the attached posture by fitting the protrusion 251 into the recess 352. Specifically, in this modification, the ink cartridge 230 in the attached state is configured to pivot between a first posture (the posture illustrated in FIG. 11) and a second posture (the posture illustrated in FIG. 12). In the first posture shown in FIG. 11, the rear surface 253 of the protrusion 251 is in contact with the surface 354 of the recess 352. In the second posture shown in FIG. 12, the rear surface 253 of the protrusion 251 is located above the surface 354 of the recess 352. The rear surface 253 is another example of the engaging surface, and the surface 354 is another example of the engaged surface.

More specifically, in order to detach the ink cartridge 230 from the cartridge-attachment section 310, in the state shown in FIG. 11, the ink cartridge 230 is pivoted clockwise in FIG. 11 about a center of the ink supply port 71 of the sealing member 76 into which the ink needle 102 is inserted. That is, the ink cartridge 230 is pivoted clockwise about a center of a part of the ink needle 102 in contact with the inner circumferential surface of the sealing member 76 defining the ink supply port 71. The ink cartridge 230 is thus pivoted from the first posture to the second posture. In the second posture, as illustrated in FIG. 12, the protrusion 251 is disengaged from the recess 352 and is located above the recess 352. By keeping the ink cartridge 230 in the second posture and moving the ink cartridge 230 rearward, the ink cartridge 230 can be detached from the cartridge-attachment section 310.

In order to attach the ink cartridge 230 to the cartridge-attachment section 310, the ink cartridge 230 is moved frontward with the protrusion 251 supported by the bottom wall of the cartridge-attachment section 310. That is, the ink cartridge 230 is moved frontward while the ink cartridge 230 is inclined such that a front portion of the ink cartridge 230 is raised relative to a rear portion of the ink cartridge 230. In other words, the ink cartridge 230 is moved frontward while being kept in the second posture. As illustrated in FIG. 12, when the ink cartridge 230 is moved frontward until the ink cartridge 230 comes to a position where the protrusion 251 is located vertically above the recess 352 of the cartridge-attachment section 310, the ink cartridge 230 is pivoted counterclockwise in FIG. 12 about the pivot center described above. The ink cartridge 230 is thus pivoted from the second posture to the first posture. As a result, the protrusion 251 is fitted into the recess 352, thereby bringing the ink cartridge 230 into the attached state (see FIG. 11). Here, since the ink cartridge 230 is urged rearward by the coil spring 78, the rear surface 253 of the protrusion 251 comes in contact with the surface 354 of the recess 352 from its front side. This contact of the rear surface 253 with the surface 354 restricts rearward movement of the ink cartridge 230.

Incidentally, in this modification, the ink cartridge 230 includes the protrusion 251, while the cartridge-attachment section 310 includes the recess 352. However, alternatively, the ink cartridge 230 may be provided with a recess, while the cartridge-attachment section 310 may include a protrusion.

In the depicted embodiment, reduction in the residual amount of ink in the ink chamber 36 is detected by the sensor arm 59 pivoting within the ink chamber 36 to displace the light-blocking portion 66 of the sensor arm 59 from the path of the light traveling from the light-emitting portion to the light-receiving portion of the residual-amount sensor 103. However, detection of the residual amount of ink in the ink chamber 36 may be performed through a different configuration from the depicted embodiment.

For example, the ink cartridge 30 may not include the sensor arm 59. Instead, the housing 62 may have a prism shape so as to bend a traveling direction of light emitted from the light-emitting portion of the residual-amount sensor 103 depending on presence or absence of ink in the housing 62. In this case, the housing 62 is an example of the detection portion.

Alternatively, the ink cartridge 30 may include a light-emitting device, instead of the housing 62 and the sensor arm 59. The light-emitting device may incorporate a battery therein, and may be configured to emit light at a predetermined timing to notify the controller that the amount of residual ink in the ink chamber 36 becomes smaller. Here, the predetermined timing may be, for example, such a timing that a prescribed number of days, which are expected to be required for consuming a predetermined amount of ink, have elapsed since the printer 10 is first turned on. In this case, the light-emitting device is an example of the detection portion.

While the residual-amount detection portion 58 (for detecting the residual amount of ink) serves as a detecting portion in the depicted embodiment, the detecting portion may be configured to detect something other than the residual amount of ink, provided that the detection portion can change the state of light depending on the state of the ink cartridge 30. For example, the light-blocking plate 67, which can change the state of the light emitted from the light-emitting portion of the attachment sensor 113, may serve as the detecting portion. In other words, the detecting portion may be the light-blocking plate 67 that can change the state of light depending on whether or not the ink cartridge 30 is in the attached state. Alternatively, the detecting portion may be a member (for example, a rib) that can change a state of light emitted from a light-emitting portion of a sensor (a type-identification sensor) depending on a type of the ink cartridge 30 (for example, a color of stored ink) attached to the cartridge-attachment section 110.

Further, instead of the plate-shaped rigid IC board 64 of the embodiment, a flexible substrate formed of a plastic film and having flexibility may be used as the electrical interface.

Further, in the above-described embodiment, the coil spring 78 of the ink supply portion 34 functions to urge the ink cartridge 30 attached to the cartridge-attachment section 110 rearward. However, a different structure from the depicted configuration may be employed for urging the ink cartridge 30 attached to the cartridge-attachment section 110 rearward.

For example, a spring for biasing the ink cartridge 30 rearward may be provided at a position other than the ink supply portion 34. For example, such a spring may be arranged in the recess 96 of the front cover 32. In this case, the spring is brought into pressure contact with the rod 125 of the cartridge-attachment section 110 during insertion of the ink cartridge 30 into the cartridge-attachment section 110, thereby urging the ink cartridge 30 rearward.

In the above-described embodiment, the light-blocking plate 67 is configured to block the light of the attachment sensor 113. That is, the light-blocking plate 67 is provided for the purpose of detecting whether or not the ink cartridge 30 is attached to the cartridge-attachment section 110. However, the light-blocking plate 67 may be provided for a different purpose. For example, the light-blocking plate 67 may be provided to identify a type of the ink cartridge 30 (for example, a color of stored ink) attached to the cartridge-attachment section 110.

In the depicted embodiment, the ink chamber 36 is defined by the inner frame 35. However, the ink chamber 36 may be defined by the rear cover 31 and the front cover 32 constituting the outer shell of the ink cartridge 30. That is, the ink cartridge 30 may be configured by the rear cover 31 and the front cover 32, without the inner frame 35 enclosed by the rear cover 31 and front cover 32. Alternatively, an ink bag for storing ink may be accommodated in the rear cover 31 and the front cover 32. In this case, the ink bag may have the same function as the inner frame 35.

Figure 13:
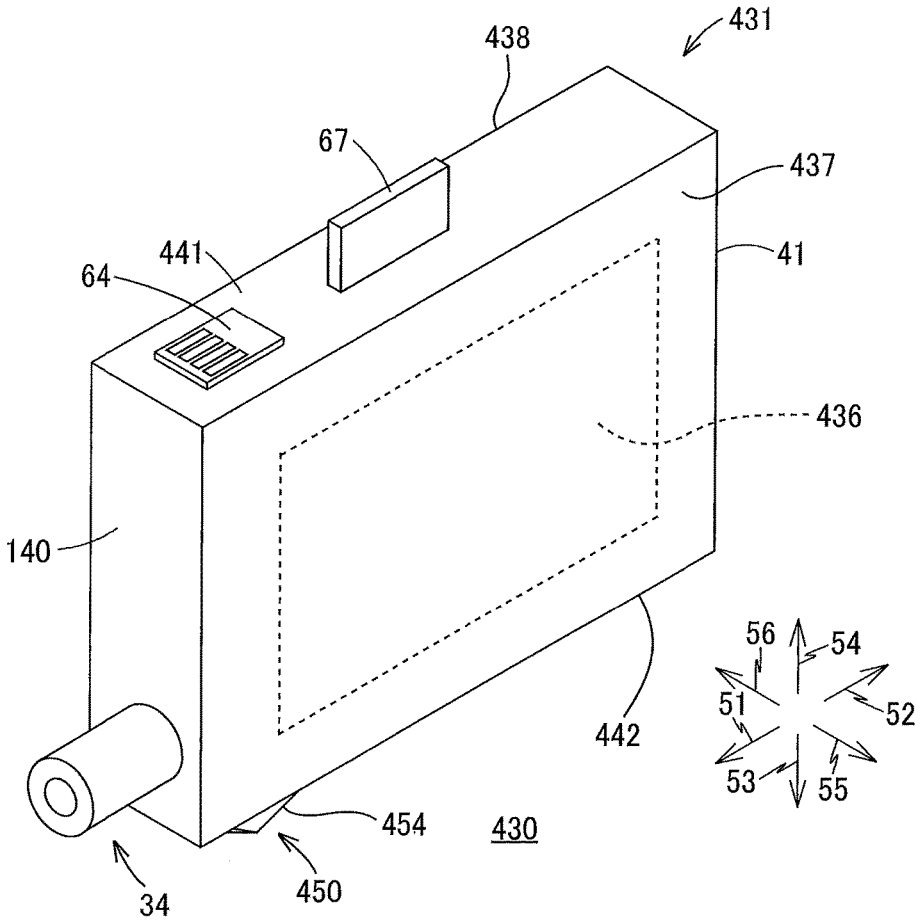
FIG. 13 is a perspective view of an ink cartridge according to a variation of the embodiment.

Still alternatively, the ink chamber 36 may be formed in a housing that does not include the rear cover 31 and front cover 32. FIG. 13 shows an ink cartridge 430 as a variation of the ink cartridge 30 of the embodiment. In this ink cartridge 430, an ink chamber 436 may be defined in a housing 431 of a rectangular parallelepiped shape. The housing 431 is an example of the cartridge body. The housing 431 includes the front wall 140, the rear wall 41, a top wall 441, a bottom wall 442 and side walls 437 and 438. Each of these walls 140, 41, 441, 442, 437 and 438 constitute an outer shell of the ink cartridge 430. In other words, the ink chamber 436 is defined by the front wall 140, the rear wall 41, the top wall 441, the bottom wall 442 and side walls 437 and 438. The ink chamber 436 is an example of the liquid chamber. The ink supply portion 34 may be provided at the front wall 140 to protrude frontward therefrom.

Further, in this ink cartridge 430, the IC board 64 and the light-blocking plate 67 and an engaging portion 450 may be disposed at the housing 431 that defines the ink chamber 436. In this ink cartridge 430, the light-blocking plate 67 is an example of the detection portion and the light-receiving portion. The attachment sensor 113 is an example of the sensor. Further, the engaging portion 450 of this variation may not include any urging member, unlike the engaging portion 130 of the embodiment. Specifically, in the engaging portion 130 of the embodiment, the coil spring 132 urges the protrusion 131 having the surfaces 133 and 134 so that the protrusion 131 is movable in the up-down direction 53 and 54. However, the engaging portion 450 of this variation may be fixedly provided at the bottom wall 442 to protrude downward therefrom. The engaging portion 450 may include an engaging surface 454. The engaging surface 454 faces rearward and is sloped relative to the bottom wall 442, but does not move relative to the bottom wall 442 in the up-down direction 53 and 54. The engaging surface 454 may be engagable with the surface 93 (engaged surface) of the recess 91 of the cartridge-attachment section 110.

Further, while ink serves as an example of the liquid in the depicted embodiments, the liquid of the present disclosure is not limited to ink. For example, a pretreatment liquid that is ejected onto sheets prior to ink during a printing operation may be stored in the liquid cartridge. Alternatively, cleaning water for cleaning the print head 21 may be stored in the liquid cartridge.

What is claimed is:

1. A liquid cartridge configured to store liquid therein, the liquid cartridge comprising:

a cartridge body defining an ink chamber storing liquid therein, the cartridge body comprising:

a front surface facing frontward;

a rear surface spaced apart from the front surface;

an upper surface disposed between the front surface and the rear surface, the upper surface facing upward;

a bottom surface disposed between the front surface and the rear surface, the bottom surface being disposed opposite to the upper surface, the bottom surface facing downward;

a liquid supply portion disposed at the front surface and configured to supply the liquid to outside of the liquid cartridge;

an electrical interface disposed at the upper surface;

a detection portion including a light-receiving portion configured to receive light thereon, the light-receiving portion being positioned upward relative to the upper surface, the detection portion being configured to change a state of the light received at the light-receiving portion depending on a state of the liquid cartridge; and an engaging portion protruding downward from the bottom surface of the cartridge body and located between the light-receiving portion and the front surface, the engaging portion including an engaging surface facing rearward.

2. The liquid cartridge as claimed in claim 1, wherein the liquid supply portion and the bottom surface define a first distance therebetween in a vertical direction, the liquid supply portion and the upper surface define a second distance therebetween in the vertical direction, the first distance being smaller than the second distance.

3. The liquid cartridge as claimed in claim 1, wherein the detection portion is configured to change the state of the light received at the light-receiving portion depending on an amount of the liquid in the liquid cartridge.

4. The liquid cartridge as claimed in claim 3, wherein the light-receiving portion is movable between a detection position and a non-detection position different from the detection position in accordance with the amount of the liquid, the light-receiving portion at the detection position being configured to block or attenuate the received light.

5. The liquid cartridge as claimed in claim 4, further comprising a light-blocking plate extending from the upper surface, the light-blocking plate being disposed between the light-receiving portion and the electrical interface, the light-blocking plate being configured to block or attenuate incident light.

6. The liquid cartridge as claimed in claim 1, the liquid cartridge being configured to be attached to a case of a liquid-consuming device, the liquid cartridge being in an attached state when attached to the case, the liquid cartridge in the attached state having a depth in a horizontal direction, a height in a vertical direction orthogonal to the horizontal direction, and a width in a widthwise direction orthogonal to the horizontal direction and the vertical direction, wherein the liquid supply portion comprises a liquid outlet and a valve movable in the horizontal direction to open and close the liquid outlet, the valve serving as a second urging member configured to urge the liquid cartridge rearward, and wherein the liquid cartridge in the attached state is pivotable between a first posture and a second posture, the engaging surface being in contact with an engaged surface of the case in the first posture, the engaging surface being located upward relative to the engaged surface of the case in the vertical direction in the second posture.

7. The liquid cartridge as claimed in claim 1, the liquid cartridge being configured to be attached to a case of a liquid-consuming device, the liquid cartridge being in an attached state when attached to the case, wherein, in the attached state of the liquid cartridge:

the cartridge body has a depth in a horizontal direction, a height in a vertical direction orthogonal to the horizontal direction, and a width in a widthwise direction orthogonal to the horizontal direction and the vertical direction;

the liquid supply portion comprises a liquid outlet facing frontward in the horizontal direction;

the front surface and the rear surface are spaced apart from each other in the horizontal direction;

the upper surface and the bottom surface are spaced apart from each other in the vertical direction; and the liquid chamber is positioned between the front surface and the rear surface.

8. A liquid-consuming device comprising:

a liquid cartridge comprising:

a cartridge body defining an ink chamber storing liquid therein, the cartridge body comprising:

a front surface facing frontward;

a rear surface spaced apart from the front surface;

an upper surface disposed between the front surface and the rear surface, the upper surface facing upward;

a bottom surface disposed between the front surface and the rear surface, the bottom surface being disposed opposite to the upper surface, the bottom surface facing downward;

a liquid supply portion disposed at the front surface and configured to supply the liquid to outside of the liquid cartridge;

an electrical interface disposed at the upper surface, the electrical interface including an electrode;

a detection portion including a light-receiving portion configured to receive light thereon, the light-receiving portion being positioned upward relative to the upper surface, the detection portion being configured to change a state of the light received at the light-receiving portion depending on a state of the liquid cartridge; and an engaging portion protruding downward from the bottom surface and located between the light-receiving portion and the front surface, the engaging portion including an engaging surface facing rearward;

a cartridge-attachment section, the liquid cartridge being attachable to the cartridge-attachment section in a frontward direction and detachable from the cartridge-attachment section in a rearward direction, the cartridge-attachment section comprising:

a case configured to accommodate the liquid cartridge therein, the liquid cartridge attached to the case being in the attached state;

a contact disposed at the case, the contact being electrically connected to the electrode of the electrical interface of the liquid cartridge attached to the case; and a sensor including a light-emitting portion and a light-receiving portion positioned opposite to each other, the light-receiving portion of the liquid cartridge attached to the case being configured to be interposed between the light-emitting portion and the light-receiving portion; and a consuming section configured to consume the liquid stored in the liquid cartridge attached to the case of the cartridge-attachment section.

9. The liquid-consuming device as claimed in claim 8, wherein the case of the cartridge-attachment section comprises a bottom wall configured to face the bottom surface of the liquid cartridge attached to the cartridge-attachment section, the bottom wall being formed with a recess that is depressed downward, the engaging surface of the liquid cartridge attached to the cartridge-attachment section being in engagement with the recess.

10. The liquid-consuming device as claimed in claim 9, wherein the liquid cartridge in the attached state has a depth in a horizontal direction, a height in a vertical direction orthogonal to the horizontal direction, and a width in a widthwise direction orthogonal to the horizontal direction and the vertical direction, wherein the liquid supply portion comprises a liquid outlet and a valve movable in the horizontal direction to open and close the liquid outlet, the valve being configured to urge the liquid cartridge in the attached state rearward;

wherein the cartridge-attachment section further comprises a tube disposed at the case and configured to be inserted into the liquid supply portion of the liquid cartridge attached to the case of the cartridge-attachment section to open the liquid outlet, and wherein the liquid cartridge in the attached state is pivotable about the tube connected to the liquid supply portion between a first posture and a second posture, the engaging surface of the liquid cartridge in the first posture being in contact with the recess, the engaging surface of the liquid cartridge in the second posture being located upward relative to the recess in the vertical direction.

11. The liquid cartridge according to claim 1, wherein the engaging portion comprises a sloped surface that is sloped relative to the bottom surface, the sloped surface serving as the engaging surface.

12. A liquid cartridge configured to store liquid therein, the liquid cartridge comprising:

a cartridge body defining an ink chamber storing liquid therein, the cartridge body comprising:

a front surface facing frontward;

a rear surface spaced apart from the front surface;

an upper surface disposed between the front surface and the rear surface, the upper surface facing upward;

a bottom surface disposed between the front surface and the rear surface, the bottom surface being disposed opposite to the upper surface, the bottom surface facing downward;

a liquid supply portion disposed at the front surface and configured to supply the liquid to outside of the liquid cartridge;

an electrical interface disposed at the upper surface;

a detection portion including a light-receiving portion configured to receive light thereon, the light-receiving portion being positioned upward relative to the upper surface, the detection portion being configured to change a state of the light received at the light-receiving portion depending on a state of the liquid cartridge; and an engaging portion movable in a vertical direction relative to the bottom surface of the cartridge body to protrude downward relative to the bottom surface of the cartridge body, the engaging portion located between the light-receiving portion and the front surface and including an engaging surface facing rearward.

13. The liquid cartridge as claimed in claim 12, wherein the engaging portion includes a protrusion configured to protrude downward relative to the bottom surface, the protrusion including a first sloped surface that is sloped relative to the bottom surface, the first sloped surface serving as the engaging surface.

14. The liquid cartridge as claimed in claim 13, wherein the protrusion further includes a second sloped surface that is disposed frontward relative to the first sloped surface, the second sloped surface being sloped relative to the bottom surface.

15. The liquid cartridge as claimed in claim 13, wherein the engaging portion comprises a first urging member configured to urge the protrusion, the first urging member urging the protrusion downward to urge the engaging surface downward.

* * * * *